US009579894B2

(12) United States Patent
Yokota

(10) Patent No.: US 9,579,894 B2
(45) Date of Patent: Feb. 28, 2017

(54) LIQUID DISCHARGING APPARATUS AND TRANSPORT AMOUNT ADJUSTMENT METHOD

(71) Applicant: SEIKO EPSON CORPORATION, Tokyo (JP)

(72) Inventor: So Yokota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/865,385

(22) Filed: Sep. 25, 2015

(65) Prior Publication Data

US 2016/0089883 A1 Mar. 31, 2016

(30) Foreign Application Priority Data

Sep. 26, 2014 (JP) ..... 2014-196272

(51) Int. Cl.

| | |
|---|---|
| ***B41J 29/38*** | (2006.01) |
| ***B41J 29/393*** | (2006.01) |
| ***B41J 2/15*** | (2006.01) |
| ***B41J 2/01*** | (2006.01) |
| ***B41J 2/145*** | (2006.01) |
| ***B41J 13/00*** | (2006.01) |
| ***B41J 19/14*** | (2006.01) |

(52) U.S. Cl.

CPC ..... *B41J 2/145* (2013.01); *B41J 13/0009* (2013.01); *B41J 19/142* (2013.01); *B41J 2029/3935* (2013.01)

(58) Field of Classification Search

CPC ..... B41J 29/393; B41J 29/38; B41J 11/425; B41J 11/42; B41J 2/145; B41J 11/46; B41J 2029/3935; B41J 13/0009; B41J 19/142

USPC ..... 347/14, 16, 19, 40, 104

See application file for complete search history.

(56) References Cited

U.S. PATENT DOCUMENTS

2006/0197785 A1* 9/2006 Uchida ..... B41J 11/425 347/5

2008/0143765 A1 6/2008 Takahashi et al.

(Continued)

FOREIGN PATENT DOCUMENTS

JP 2010-194959 A 9/2010

OTHER PUBLICATIONS

Extended European Search Report dated Oct. 14, 2016 in related European Appl. 15186867.6 (8 pgs.).

*Primary Examiner* — Jannelle M Lebron

(74) *Attorney, Agent, or Firm* — Foley & Lardner LLP

(57) ABSTRACT

A liquid discharging apparatus includes a discharging unit that includes a row of nozzles configured to discharge a liquid, the discharging unit being configured to reciprocate in an outward direction and a return direction, the outward and return directions being transverse to the nozzle row; and a transport unit configured to intermittently transport a medium in a direction transverse to the outward and return directions. The liquid discharging apparatus is configured to form at least one adjustment pattern for adjusting a transport amount of each individual transport during the intermittent transport. The liquid discharging apparatus is configured to form the at least one adjustment pattern such that the at least one adjustment pattern includes both an outward direction movement pattern formed while moving the discharging unit in the outward direction and a return direction movement pattern formed while moving the discharging unit in the return direction.

10 Claims, 19 Drawing Sheets

(56) References Cited

U.S. PATENT DOCUMENTS

| | | | | |
|---|---|---|---|---|
| 2008/0225068 | A1* | 9/2008 | Morino | B41J 2/2135<br>347/14 |
| 2010/0328383 | A1 | 12/2010 | Yoshikawa et al. | |
| 2012/0033006 | A1 | 2/2012 | Murayama et al. | |

* cited by examiner

LIQUID DISCHARGING APPARATUS AND TRANSPORT AMOUNT ADJUSTMENT METHOD

CROSS-REFERENCE TO RELATED APPLICATIONS

The present application is based upon and claims priority to Japanese Patent Application No. 2014-196272, filed on Sep. 26, 2014, the contents of which are incorporated by reference in their entirety.

BACKGROUND

1. Technical Field

The present disclosure relates to a liquid discharging apparatus and a transport amount adjustment method.

2. Related Art

In the related art, liquid discharging apparatuses, such as recording devices, have been provided. Such apparatuses discharge a liquid to a medium, such as a recording medium, transported in a direction that intersects the direction of reciprocation while a discharging unit that discharges a fluid, such as ink, is reciprocated. In such a liquid discharging apparatus, adjusting the transport amount of the medium is generally performed before discharging the liquid to the medium, such as forming an image on the recording medium with ink, for example.

For example, JP-A-2010-194959 discloses a recording apparatus that transports a recording medium and performs recording by discharging ink to the recording medium by a recording head as a discharging unit is reciprocated in a direction that intersects a transport direction of the recording medium. The recording apparatus is able to form an adjustment pattern for adjusting the landing position of the ink and the transport amount of the recording medium.

In a general liquid discharging apparatus of the related art, that discharges a liquid to a medium transported in a direction that intersects the reciprocation direction while the discharging unit is reciprocated, the transport amount of the medium is adjusted by discharging the liquid by only a single movement operation of the discharging unit in the outward direction or the return direction of the reciprocation when the transport amount of the medium is adjusted. In detail, the reference pattern is formed according to the single movement operation of the discharging unit in the outward direction or the return direction, and the transport amount adjustment pattern is formed corresponding to the reference pattern while the discharging unit is being moved in the same direction as the movement direction of the discharging unit when the reference pattern is formed after the medium is transported by a predetermined transport amount.

However, accompanying the increases in resolution and speed of liquid discharging apparatuses in recent years, the volume of liquid droplets discharged from the discharging unit is decreasing, and the movement speed of the discharging unit is increasing. Accompanying this, the liquid droplets discharged from the discharging unit are easily influenced by air flow generated when the discharging unit reciprocates. Therefore, there are cases where shifting arises in the discharge direction of the liquid droplets discharged from the discharging unit in the direction that intersects the reciprocation direction of the discharging unit during movement in the outward direction and during movement in the return direction of the discharging unit due to the influence of the air flow. That is, in a case where the transport amount adjustment method of the related art is performed, the transport precision of the medium may become insufficient in one of the transport after movement in the outward direction of the discharging unit or transport after movement in the return direction of the discharging unit.

In the recording apparatus disclosed in JP-A-2010-194959, it is necessary to form the adjustment pattern for adjusting the transport amount after verifying shifting of the landing position of the ink in the transport direction of the medium according to the reciprocation of the discharging unit, and the adjustment of the transport precision of the medium becomes complicated.

SUMMARY

An advantage of some aspects of the invention is to provide a liquid discharging apparatus that discharges a liquid on a medium transported in a direction that intersects the reciprocation direction while a discharging unit is reciprocated, in which adjusting the transport precision of a medium with high precision is simple.

According to an aspect of the invention, there is provided a liquid discharging apparatus, including: a discharging unit that includes a nozzle row that discharges a liquid and is able to reciprocate in a first direction that intersects the nozzle row; a transport unit that is able to intermittently transport a medium in a second direction that intersects the first direction, in which the liquid discharging apparatus is able to form an adjustment pattern for adjusting a transport amount of one transport in intermittent transport, the adjustment pattern is formed using both of an outward direction movement pattern formed while moving the discharging unit in the outward direction from the first direction and a return direction movement pattern formed while moving the discharging unit in the return direction from the first direction.

In the liquid discharging apparatus, the adjustment pattern may include a reference pattern formed from one of the outward direction movement pattern and the return direction movement pattern, and a transport amount adjustment pattern formed after the medium is transported a predetermined amount after the reference pattern is formed, and along therewith formed from the other of the outward direction movement pattern and the return direction movement pattern.

In the liquid discharging apparatus, the adjustment pattern may include a transport amount adjustment pattern formed after the medium is transported a predetermined amount after the reference pattern formed from the outward direction movement pattern and the reference pattern formed from the outward direction movement pattern are formed, and a transport amount adjustment pattern formed after the medium is transported a predetermined amount after the reference pattern formed from the return direction movement pattern and the reference pattern formed from the return direction movement pattern are formed.

In the liquid discharging apparatus, a plurality of the adjustment patterns may be formed with the nozzle used in the nozzle row shifted in at least one of the outward direction movement pattern and the return direction movement pattern with respect to the reference pattern.

In the liquid discharging apparatus, a plurality of the adjustment patterns may be formed with the predetermined transport amount changed.

In the liquid discharging apparatus, the transport amount adjustment pattern P2 may be formed at a position overlapping the reference pattern P1 when viewed from the second direction A.

In the liquid discharging apparatus, the predetermined transport amount may be at least one of a sum and a difference of a reference transport amount and a length in which a second integer equal to or less than a first integer is multiplied by a length in which the distance between neighboring nozzles of the nozzle row is divided by the first integer.

In the liquid discharging apparatus, a plurality of adjustment patterns may be formed in the second direction with the predetermined transport amount changed by changing the second integer, and along therewith a plurality of the adjustment patterns may be formed in the first direction by forming a plurality of transport amount adjustment patterns in the first direction with each nozzle used in the nozzle row changed after the plurality of adjustment patterns is formed in the first direction, and the transport amount adjustment pattern formed using the same nozzle as the nozzle with which the reference pattern is formed may be arranged shifted when viewed from the second direction in the adjustment pattern plurally formed in the second direction.

According to another aspect of the invention, there is provided a transport amount adjustment method that is able to be executed using a liquid discharging apparatus provided with a discharging unit that has nozzle rows that discharge a liquid and is able to be reciprocated in a first direction intersecting the nozzle rows, and a transport unit that is able to intermittently transport a medium in a second direction that intersects the first direction, the method including: forming an adjustment pattern by which a transport adjustment amount of one transport in the intermittent transport is adjusted is formed while moving the discharging unit in both of an outward direction in the first direction and a return direction in the first direction; and adjusting the transport amount of one transport performed after moving the discharging unit in the outward direction and the transport amount of one transport performed after moving the discharging unit in the return direction based on the adjustment pattern to a common transport amount.

According to aspects of the invention, a liquid discharging apparatus that discharges a liquid on a medium transported in a direction that intersects the reciprocation direction while a discharging unit is reciprocated may simply adjust the transport precision of a medium with high precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

The recording apparatus 1 will be described in detail as a liquid discharging apparatus according to an embodiment of the invention with reference to the attached drawings.

Firstly, an outline of the recording apparatus according to an embodiment of the invention is described.

Figure 1:
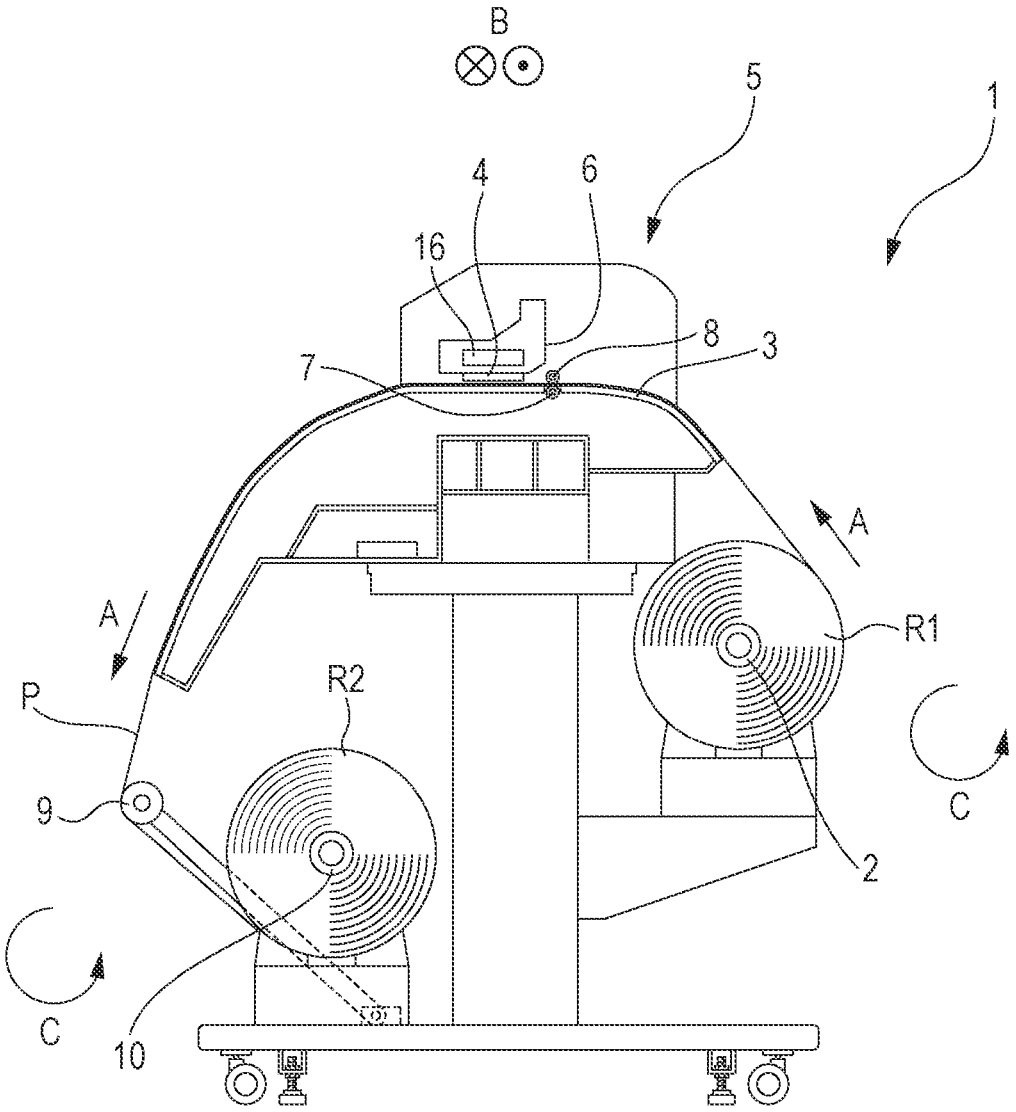
FIG. 1 is a schematic side view showing a recording apparatus according to an embodiment of the invention.

FIG. 1 is a schematic side view of the recording apparatus 1 according to the embodiment.

The recording apparatus 1 of the embodiment includes a support shaft 2 that supports a roll R1 of the roll-like recording medium (medium) P for performing recording. The support shaft 2 rotates in the rotation direction C, when the recording apparatus 1 of the embodiment transports the recording medium P in the transport direction A. In the embodiment, although the roll-type recording medium P wound so that the recording surface becomes the outside is used, sending out the roll R1 by reversely rotating to the rotation direction C of the support shaft 2 in a case of using the roll-type recording medium P wound so that the recording surface becomes the inside is also possible.

Although the recording apparatus 1 of the embodiment uses the roll-type recording medium as the recording medium P, there is no limitation to a recording apparatus using such a roll-type recording medium. For example, a cutform-type recording medium may be used.

The recording apparatus 1 of the embodiment is provided with a transport roller pair 5 made of a driving roller 7 and a driven roller 8 as a transport unit for transporting the recording medium P in the transport direction A.

In the recording apparatus 1 of the embodiment, the driving roller 7 is configured by one roller extending in the direction B that intersects the transport direction A of the recording medium P, and a plurality of driven rollers 8 are provided lined up in the direction B at positions facing the driving roller 7.

A heater, not shown, able to heat the recording medium P supported on a medium support unit 3 is provided on the lower part of the medium support unit 3. In this way, although the recording apparatus 1 of the embodiment is provided with a heater able to heat the recording medium P from the medium support unit 3 side, the recording apparatus may be provided with an infrared ray heater provided at a position facing the medium support unit 3. In the case of using an infrared ray heater, the preferable wavelength of the infrared rays is 0.76 μm to 1000 μm. Generally, the infrared rays are further divided into near-infrared rays, mid-infrared rays, and far-infrared rays according to the wavelength, and although there are various definitions of the division, approximate wavelength regions are 0.78 μm to 2.5 μm, 2.5 μm to 4.0 μm, and 4.0 μm to 1000 μm. Among these, it is preferable to use the mid-infrared rays.

The recording apparatus 1 of the embodiment is provided with a recording head 4 as a discharging unit that performs recording by discharging ink from the nozzles of a nozzle forming surface in which a plurality of nozzles is provided, and a carriage 6 mounted to the recording head 4 and able to reciprocate in the direction B.

A sensor 16 is provided as a reading unit that reads the ink discharged from the recording head 4 to the recording medium P in the carriage 6, and is able to read in the entire width direction of the recording medium P corresponding to the direction B through which the carriage 6 moves in the direction B.

A winding shaft 10 able to wind up the recording medium P as a roll R2 is provided on the downstream side in the transport direction A of the recording medium P of the recording head 4. In the embodiment, since the recording medium P is wound so that the recording surface becomes the outside, the winding shaft 10 rotates in the rotation direction C when the recording medium P is wound. However, in a case of winding so that the recording surface becomes the inside, winding by reverse rotation to the rotation direction C is possible.

A contact portion with the recording medium P is provided extending in the direction B between the end portion on the downstream side in the transport direction A of the recording medium P in the medium support unit 3, and the winding shaft 10. For example, a tension bar 9, which is able to apply a desired tension to the recording medium P, is provided.

Next, the electrical configuration of the recording apparatus 1 of the embodiment will be described.

Figure 2:
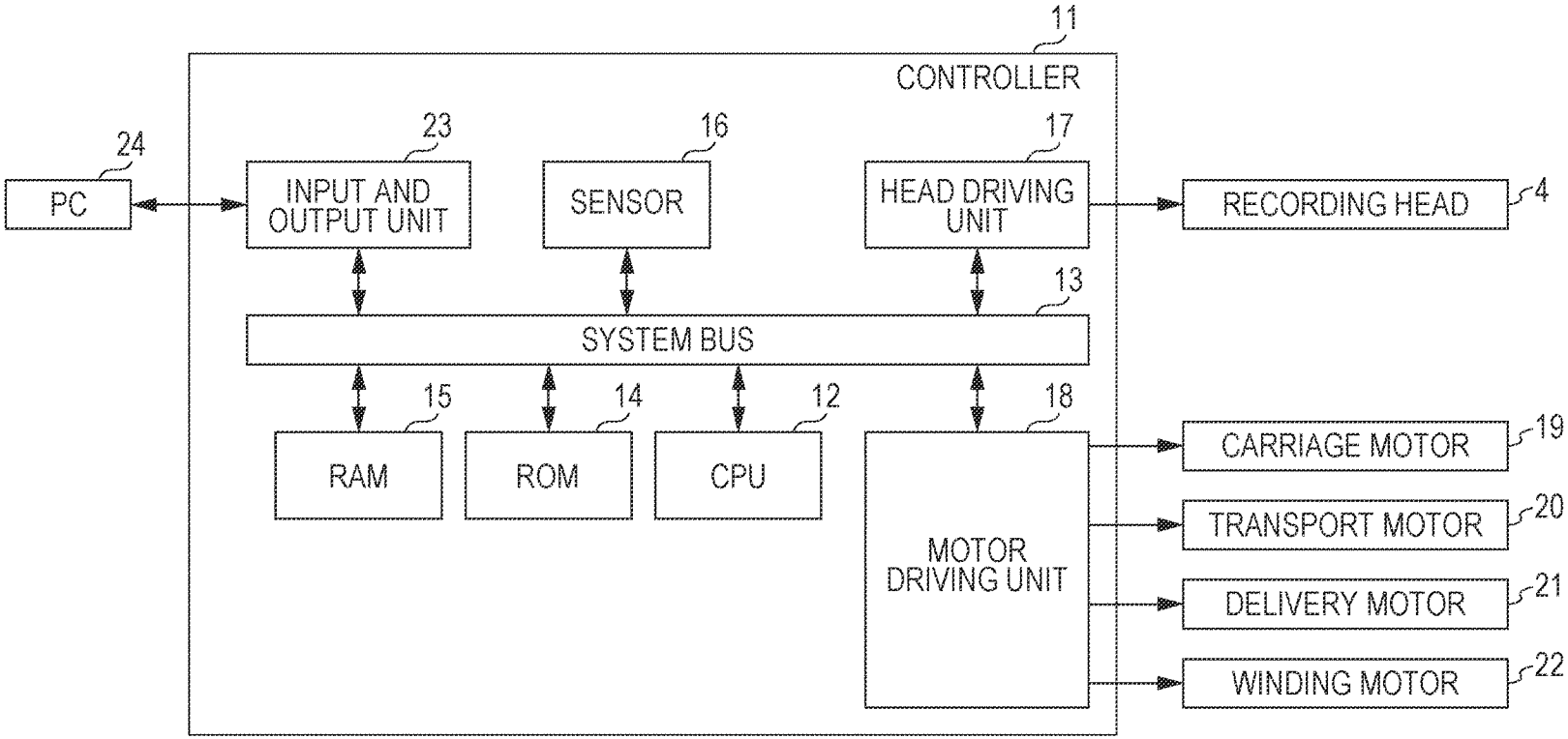
FIG. 2 is a block diagram of the recording apparatus according to an embodiment of the invention.

FIG. 2 is a block diagram of the recording apparatus 1 of the embodiment.

A CPU 12 that administers overall control of the recording apparatus 1 is provided in the controller 11. The CPU 12 is connected via a system bus 13 to the ROM 14 in which various control programs and the like executed by the CPU 12 are stored and a RAM 15 able to temporarily store data.

The CPU 12 is connected to the sensor 16 via the system bus 13.

The CPU 12 is connected via the system bus 13 to a head driving unit 17 for driving the recording head 4.

The CPU 12 is connected to the carriage motor 19, transport motor 20, delivery motor 21, and winding motor 22, and connected to the motor driving unit 18 via the system bus 13.

Here, the carriage motor 19 is a motor for driving the carriage 6 mounted to the recording head 4 in the direction B. The transport motor 20 is a motor for driving the driving roller 7 of the transport roller pair 5. The delivery motor 21 is a motor that is a rotation mechanism of the support shaft 2, and drives the support shaft 2 in order to deliver the recording medium P to the transport roller pair 5. The winding motor 22 is a driving motor for rotating the winding shaft 10.

The CPU 12 is further connected to the PC 24 for transmitting and receiving data, such as recording data, and signals and connected to the input-output unit 23 via the system bus 13.

The controller 11 of the embodiment is able to control the recording head 4, sensor 16, carriage 6 and the like through such a configuration. Although the details are described later, when recording the adjustment pattern, the recording head 4, carriage 6, and the transport unit 5 are controlled so as to transport the recording medium P a predetermined amount after a plurality of reference patterns P1 (refer to FIG. 4) are recorded, and thereafter record the plurality of transport amount adjustment patterns P2 (refer to FIG. 7) with the nozzle used shifted in the nozzle row N (refer to FIG. 3) with respect to each of the plurality of reference patterns.

Next, the recording head 4 in the recording apparatus 1 of the embodiment is described.

Figure 3:
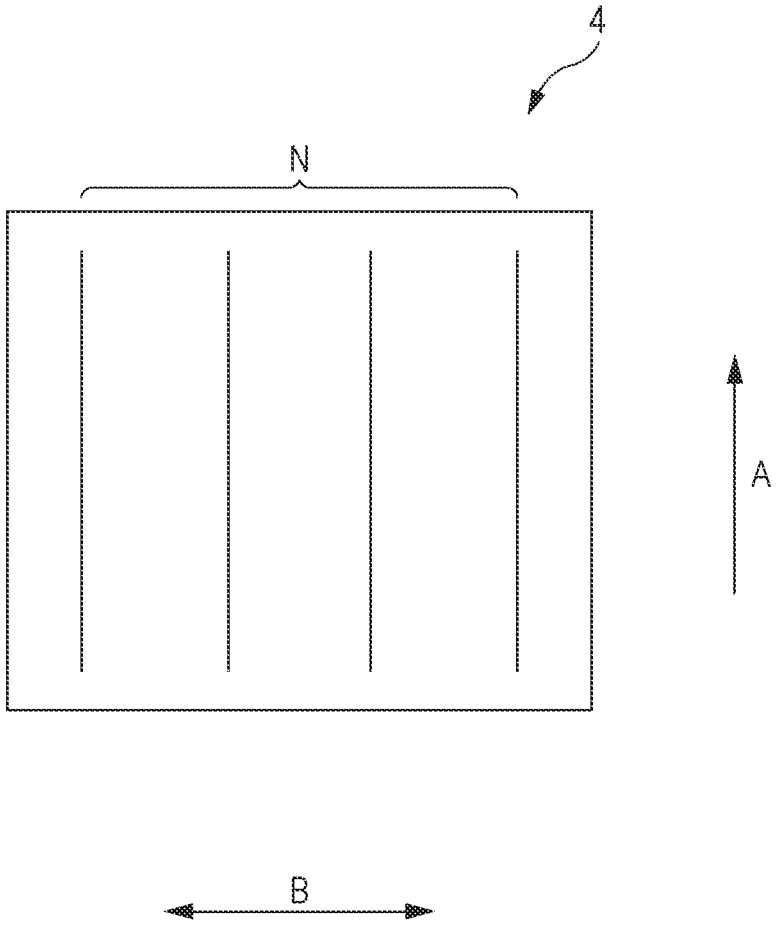
FIG. 3 is a schematic bottom view showing a recording head of the recording apparatus according to an embodiment of the invention.

FIG. 3 is a bottom view of the recording head 4 in the recording apparatus 1 of the embodiment.

As shown by FIG. 3, the recording head 4 of the embodiment includes a plurality of nozzle rows N that discharge ink. The nozzle rows N are arranged so as to be even in the direction that intersects the direction B in which the recording head 4 reciprocates. However, there is no limitation to the recording head 4 with such a configuration, and a configuration may be used in which the nozzle rows N are arranged so as to be shifted in the direction that intersects the direction B.

The recording apparatus 1 of the embodiment has a configuration able to record using black, cyan, magenta, and yellow inks. Nozzle rows N are provided corresponding to the respective inks in the recording head 4.

Here, as shown in FIG. 3, the direction of each of the nozzle rows (direction in which the nozzles are lined up in each nozzle row N) is a direction following the transport direction A that is a direction that intersects the direction B in which the recording head 4 reciprocates. In other words, the recording head 4 reciprocates in the direction B that intersects the nozzle rows N, and when the direction B that intersects the nozzle rows N is the first direction, the transport unit 5 transports the recording medium P in the transport direction A that is the second direction that intersects the first direction.

The recording apparatus 1 of the embodiment performs recording by repeating transport of the recording medium P in the transport direction A through the transport unit 5 and reciprocation of the recording head 4 in the direction B. In detail, the recording medium P is stopped after being transported a predetermined amount, and ink is discharged to the recording medium P in a stopped state while the recording head 4 is moved in the direction B. Transport of the recording medium P by a predetermined amount and discharge of the ink to the recording medium P in the stopped state is repeated.

Because the recording apparatus 1 of the embodiment performs recording by performing such intermittent transport, there is demand for adjusting the transport amount of one transport of the recording medium P according to the intermittent transport with high precision. Therefore, the recording apparatus 1 of the embodiment is configured to be able to record an adjustment pattern in order to adjust the transport amount of one transport of the recording medium P according to the intermittent transport.

Next, the adjustment pattern in the recording apparatus 1 of the embodiment is described.

FIGS. 4 to 8 are schematic views for describing an example of forming the adjustment pattern for adjusting the transport amount of one transport of the recording medium P according to the intermittent transport in the recording apparatus 1 of the embodiment.

Here, the recording apparatus 1 of the embodiment is able to perform a so-called four pass recording for forming an image at the same location on the recording medium P by causing the recording head 4 to reciprocate twice in the direction B, that is, according to moving twice in the outward direction B1 and twice in the return direction B2 for a total of four times. When four pass recording is performed, although recording is performed by dividing the nozzle rows N by four, the example of forming the main adjustment pattern shown by FIGS. 4 to 8 is an example of adjustment of the transport amount corresponding to when the four pass recording is performed.

Figure 4:
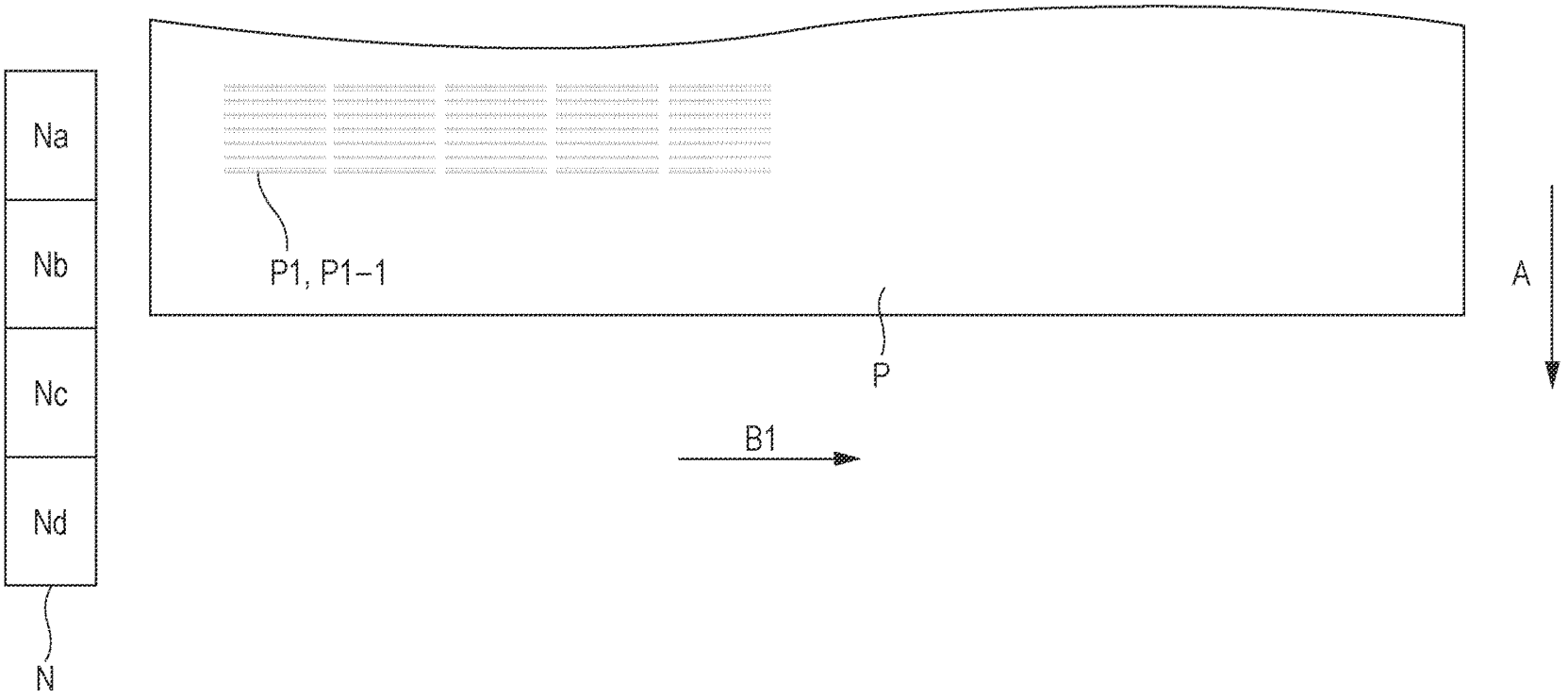
FIG. 4 is a schematic view for describing an adjustment pattern of the recording apparatus according to an embodiment of the invention.

In the example of formation of the adjustment pattern of the embodiment, initially, the reference pattern P1-1 indicated in light grey is recorded by the nozzles of the region Na of the nozzle row N of the recording head 4 while the recording head 4 is moved in the outward direction B1 from the direction B, as shown in FIG. 4.

In the example of formation of the adjustment pattern of the embodiment, the nozzle row N is divided in four regions of region Na, region Nb, region Nc, and region Nd. The transport amount adjustment pattern P2 is formed using the region Nd at a position overlapping the reference pattern P1 formed using the region Na when seen from the transport direction A.

In FIG. 4, although five reference patterns P1-1 with seven stages in the direction following the transport direction A are formed along the outward direction B1, all five of the reference patterns P1-1 are formed using the same nozzles in the region Na. However, the number of stages in the direction along the transport direction A or the number items in the direction along the outward direction B1 of the reference pattern P1-1 can be changed, as appropriate, according to the number of nozzles of the nozzle row N, or the like.

Figure 5:
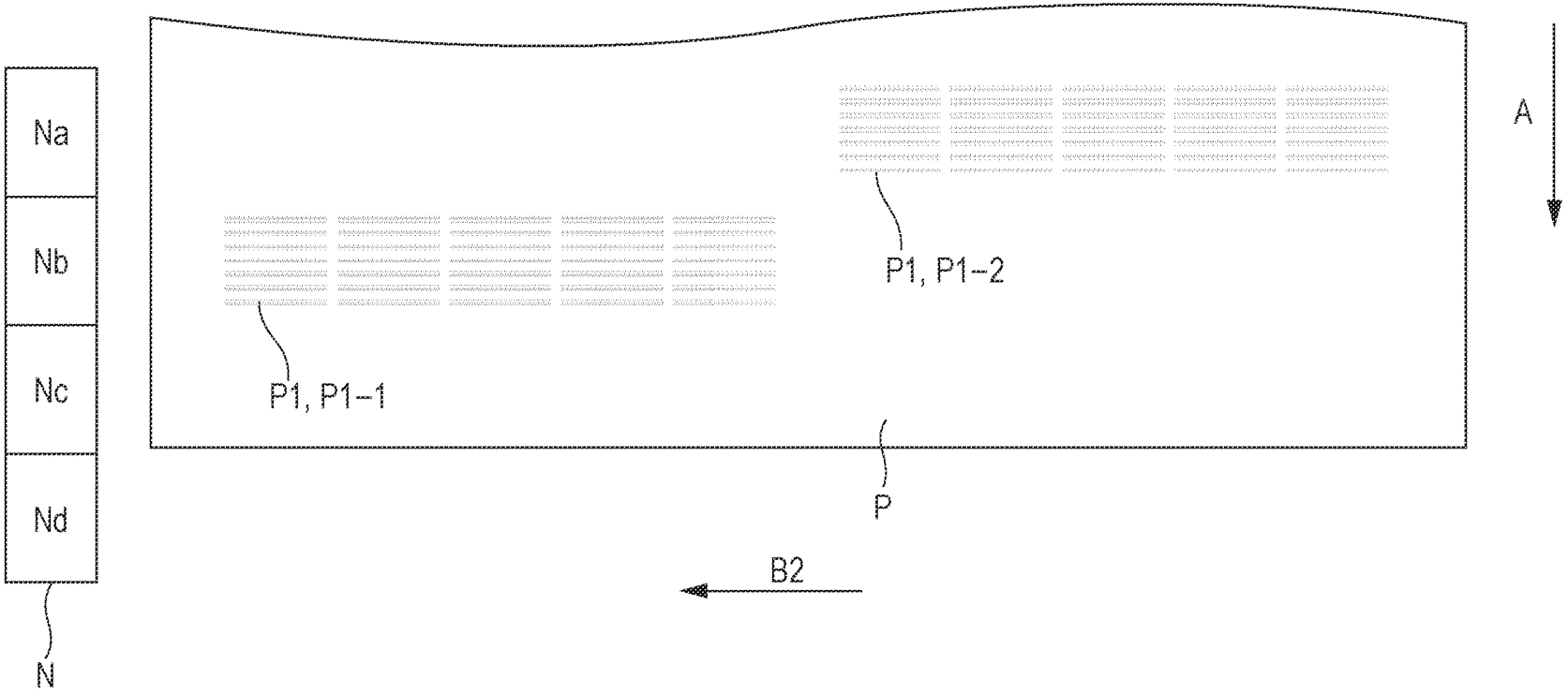
FIG. 5 is a schematic view for describing an adjustment pattern of the recording apparatus according to an embodiment of the invention.

When the recording medium P is transported by a predetermined transport amount in the transport direction A, next, the reference pattern P1-2 indicated in light grey is recorded by the nozzles in the region Na of the nozzle row N of the recording head 4 while the recording head 4 is moved in the return direction B2 of the direction B, as shown in FIG. 5.

In FIG. 5, although five reference patterns P1-2 with seven stages in the direction following the transport direction A are formed along the return direction B2, all five of the reference patterns P1-2 are formed using the same nozzles in the region Na. However, the number of stages in the direction along the transport direction A or the number items in the direction along the return direction B2 of the reference pattern P1-2 can be changed, as appropriate, according to the number of nozzles of the nozzle row N, or the like.

Figure 6:
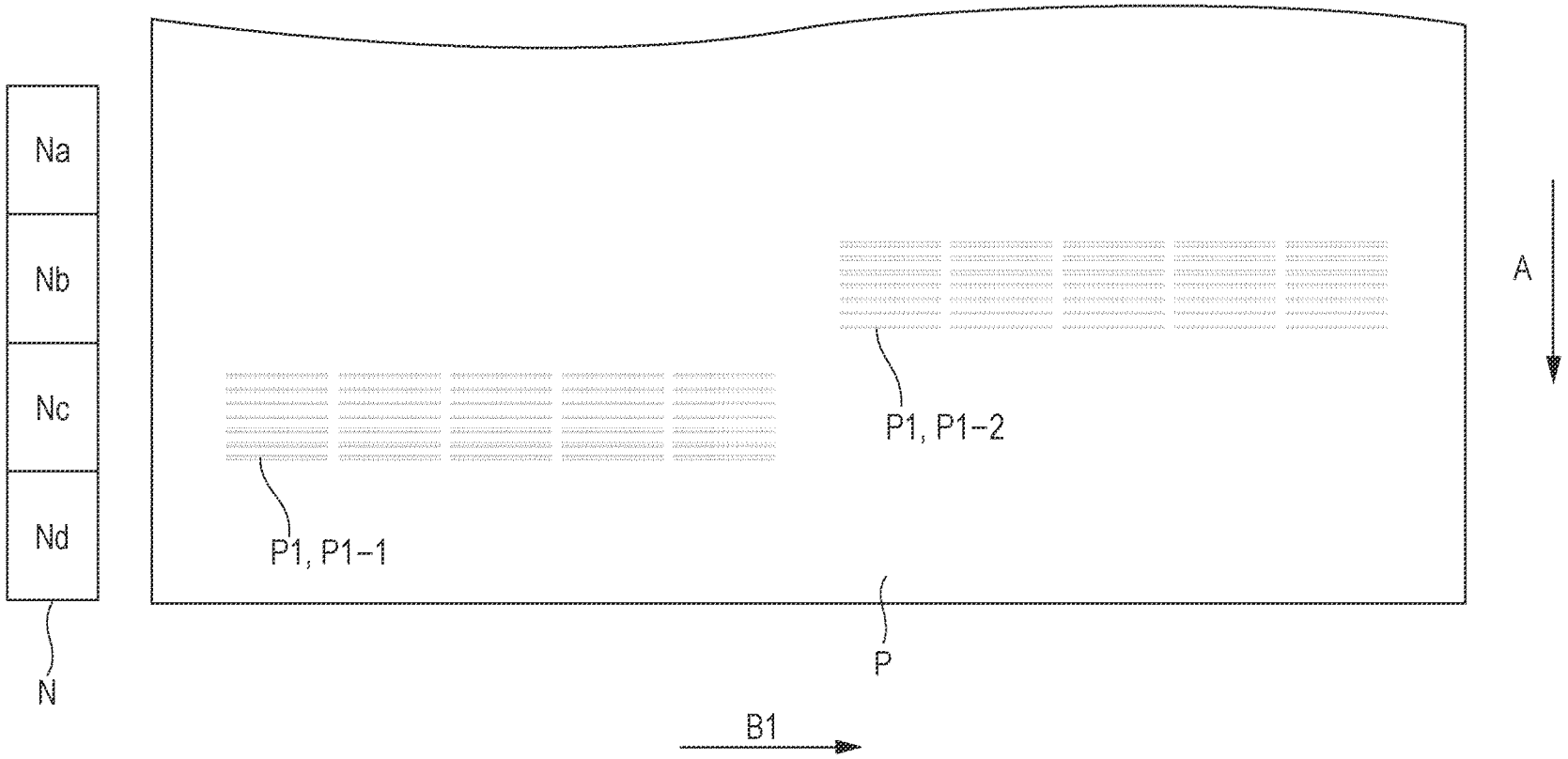
FIG. 6 is a schematic view for describing the adjustment pattern of the recording apparatus according to an embodiment of the invention.

When the recording medium P is transported by a predetermined transport amount in the transport direction A, next, the recording head 4 is moved in the outward direction B1, as shown in FIG. 6.

Figure 7:
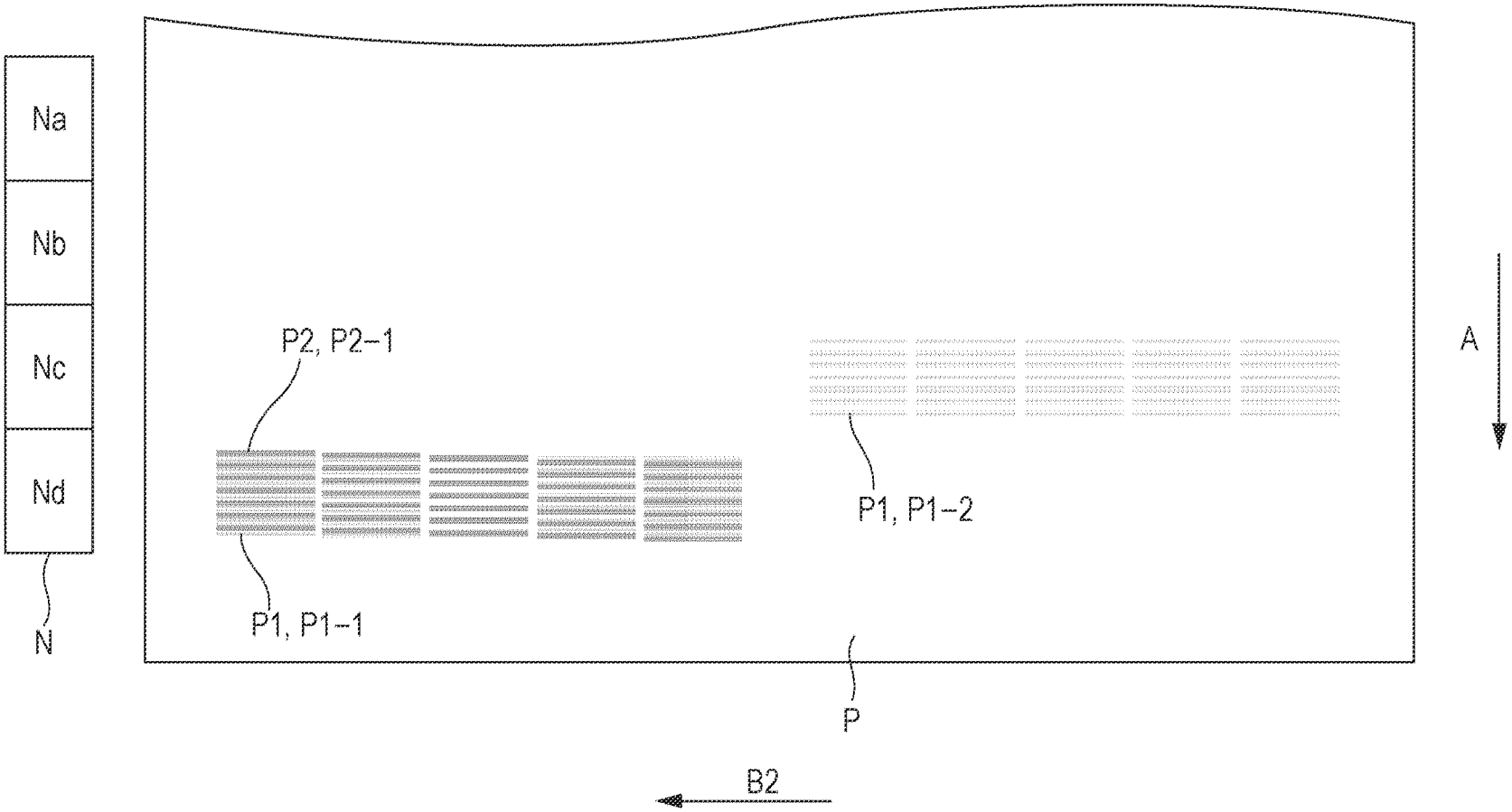
FIG. 7 is a schematic view for describing the adjustment pattern of the recording apparatus according to an embodiment of the invention.

When the recording medium P is transported by a predetermined transport amount in the transport direction A, next, the transport amount adjustment pattern P2-1 indicated in dark grey is recorded by the nozzles in the region Nd of the nozzle row N of the recording head 4 while the recording head 4 is moved in the return direction B2, as shown in FIG. 7.

In FIG. 7, although five transport amount adjustment patterns P2-1 with seven stages in the direction following the transport direction A are formed along the return direction B2, the five transport amount adjustment patterns P2-1 are each formed using different nozzles in the region Nd. In detail, the five transport amount adjustment patterns P2-1 are formed with the nozzles used shifted to the downstream side in the transport direction A in the region Nd toward the right side in the drawing. In FIG. 7, the transport amount adjustment pattern P2-1 in the center of the drawing from the five transport amount adjustment patterns P2-1 is assumed to overlap the reference pattern P1-1. In this way, the plurality of adjustment patterns are formed while changing the transport amount, and the transport amount becomes the desired transport amount in a case where the transport amount adjustment pattern P2-1 overlaps the reference pattern P1-1 at the assumed position.

However, the number of stages in the direction along the transport direction A or the number items in the direction along the return direction B2 of the transport amount adjustment pattern P2-1 can be changed, as appropriate, according to the number of nozzles of the nozzle row N, or the like.

Figure 8:
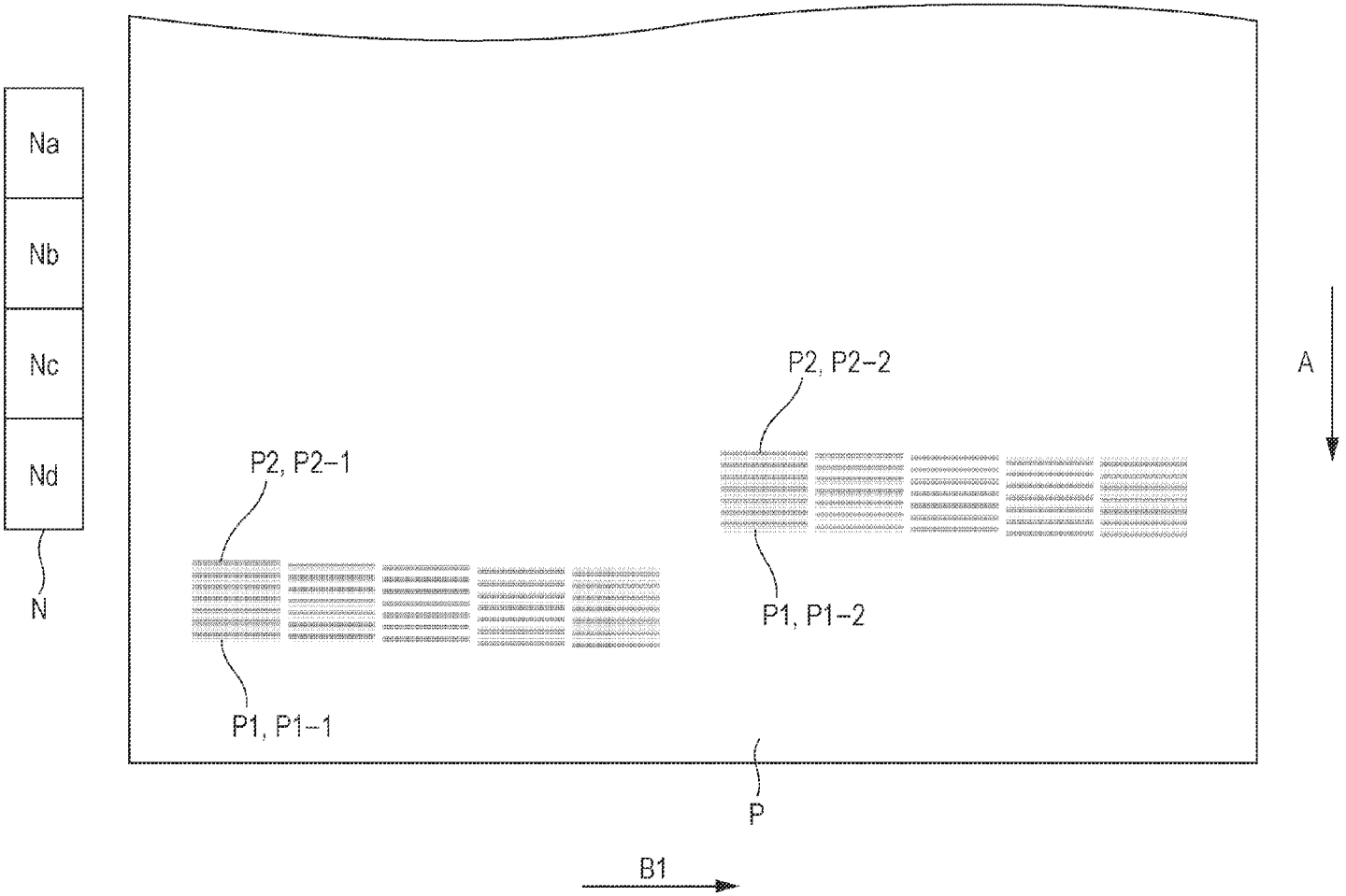
FIG. 8 is a schematic view for describing the adjustment pattern of the recording apparatus according to an embodiment of the invention.

When the recording medium P is transported by a predetermined transport amount in the transport direction A, next, the transport amount adjustment pattern P2-2 indicated in dark grey is recorded by the nozzles in the region Nd of the nozzle row N of the recording head 4 while the recording head 4 is moved in the outward direction B1, as shown in FIG. 8.

In FIG. 8, although five transport amount adjustment patterns P2-2 with seven stages in the direction following the transport direction A are formed along the outward direction B1, the five transport amount adjustment patterns P2-2 are each formed using different nozzles in the region Nd. In detail, the five transport amount adjustment patterns P2-2 are formed with the nozzles used shifted to the downstream side in the transport direction A in the region Nd toward the right side in the drawing. In FIG. 8, the transport amount adjustment pattern P2-2 in the center of the drawing from the five transport amount adjustment patterns P2-2 is assumed to overlap the reference pattern P1-2. In this way, the plurality of adjustment patterns is formed while changing the transport amount, the transport amount becomes the desired transport amount in a case where the transport amount adjustment pattern P2-2 overlaps the reference pattern P1-2 at the assumed position.

However, the number of stages in the direction along the transport direction A or the number items in the direction along the outward direction B1 of the transport amount adjustment pattern P2-2 can be changed, as appropriate, according to the number of nozzles of the nozzle row N, or the like.

As above, the adjustment pattern of the embodiment is formed by recording the reference pattern P1-1 and the transport amount adjustment pattern P2-2 while moving the recording head 4 in the outward direction B1, and recording the reference pattern P1-2 and the transport amount adjustment pattern P2-1 while moving the recording head 4 in the return direction B2. In other words, the adjustment pattern of the embodiment is formed using both of the outward direction movement pattern formed while moving the recording head 4 in the outward direction B1 and the return direction movement pattern formed while moving the recording head 4 in the return direction B2.

By forming a plurality of adjustment patterns while changing the transport amount, it is possible to adjust an appropriate transport amount based on a case where the reference pattern P1-1 and the transport amount adjustment pattern P2-1 overlap and a case where the reference pattern P1-2 and the transport amount adjustment pattern P2-2 overlap. The details of the adjustment of the appropriate transport amount are described later. By the appropriate transport amount based on the reference pattern P1-1 and the transport amount adjustment pattern P2-1 and the appropriate transport amount based on the reference pattern P1-2 and the transport amount adjustment pattern P2-2 being shared, adjustment of the transport amount of one transport performed after movement in the outward direction B1 of the discharging unit 4 and the transport amount of one transport performed after movement in the return direction B2 of the discharging unit 4 to a shared transport amount is possible.

Therefore, by forming the reference patterns in this way, it is possible to simply apply an acceptable transport amount in both of transport after movement in the outward direction B1 of the recording head 4 and transport after movement in the return direction B2 of the recording head 4. Accordingly, it is possible to simply adjust the transport precision of the recording medium P with a high precision.

In the embodiment, an average value of the optimal transport amount based on the reference pattern P1-1 and the transport amount adjustment pattern P2-1 and the optimal transport amount based on the reference pattern P1-2 and the transport amount adjustment pattern P2-2 is employed as an acceptable transport amount. However, there is no limitation to the average value.

The adjustment method of the transport amount is not particularly limited, and, for example, it is possible to use a configuration in which the controller 11 automatically determines the transport amount from the reading results by the sensor 16 or a configuration in which a user is able to select or input the transport amount from a panel, not shown, or the like provided in the recording apparatus 1.

In other words, the adjustment pattern of the embodiment includes a reference pattern P1-1 that is an outward direction movement pattern and a transport amount adjustment pattern P2-1 that is a return direction movement pattern, and along therewith, formed at a position overlapping the reference pattern P1-1 when viewed from the transport direction A by being formed after the recording medium P is transported by a predetermined transport amount after the reference pattern P1-1 is formed.

The reference pattern P1-2 that is a return direction movement pattern and the transport amount adjustment pattern P2-2 that is an outward direction movement pattern, and along therewith, formed at a position overlapping the reference pattern P1-2 when viewed from the transport direction A by being formed after the recording medium P is transported by a predetermined transport amount after the reference pattern P1-2 is formed are included.

By forming the transport amount adjustment pattern P2 at a location overlapping the reference pattern P1 seen from the transport direction A, comparison of the reference pattern P1 and the transport amount adjustment pattern P2 in the transport direction A is easy. Accordingly, it is possible to simply adjust the transport precision of the recording medium P with high precision.

Next, another example of the formation of the adjustment pattern in the recording apparatus 1 of the embodiment is described.

FIGS. 9 to 12 are schematic views for describing an example of forming the adjustment pattern for adjusting the transport amount of one transport of the recording medium P according to the intermittent transport in the recording apparatus 1 of the embodiment.

Here, the recording apparatus 1 of the embodiment is able perform a so-called three-pass recording for forming an image at the same location on the recording medium P by causing the recording head 4 to reciprocate one and a half times in the direction B, that is, according to a total of three movements. By performing three-pass recording, it is possible to make the recording speed faster than that of the four-pass recording. When three-pass recording is performed, although recording is performed by dividing the nozzle rows N by three, the example of forming the main adjustment pattern shown by FIGS. 9 to 12 is an example of adjustment of the transport amount corresponding to when the three-pass recording is performed.

Figure 9:
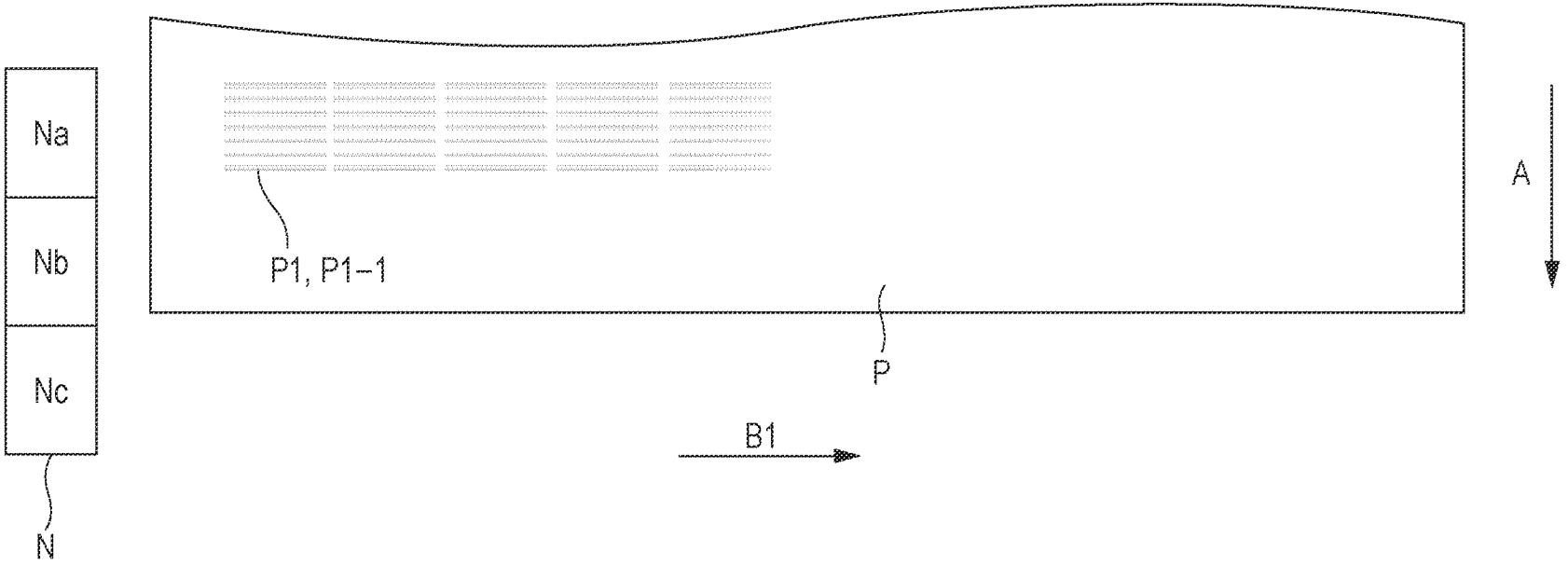
FIG. 9 is a schematic view for describing the adjustment pattern of the recording apparatus according to an embodiment of the invention.

In the example of formation of the adjustment pattern of the embodiment, initially, the reference pattern P1-1 indicated in light grey is recorded by the nozzles of the region Na of the nozzle row N of the recording head 4 while the recording head 4 is moved in the outward direction B1 from the direction B, as shown in FIG. 9.

In the example of formation of the adjustment pattern of the embodiment, the nozzle row N is divided in three regions of region Na, region Nb, and region Nc, and the transport amount adjustment pattern P2 is formed using the region Nc at a position overlapping the reference pattern P1 formed using the region Na when seen from the transport direction A.

In FIG. 9, although five reference patterns P1-1 with seven stages in the direction following the transport direction A are formed along the outward direction B1, all five of the reference patterns P1-1 are formed using the same nozzles in the region Na. However, the number of stages in the direction along the transport direction A or the number items in the direction along the outward direction B1 of the reference pattern P1-1 can be changed, as appropriate, according to the number of nozzles of the nozzle row N, or the like.

Figure 10:
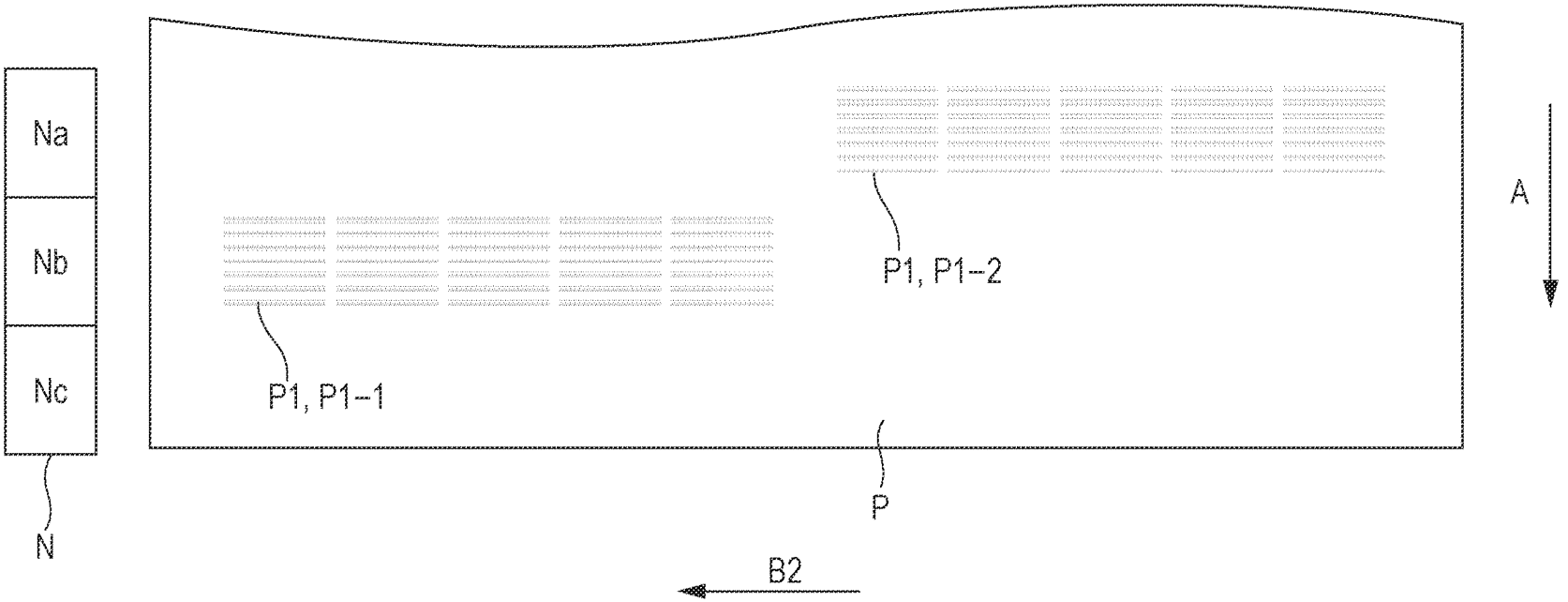
FIG. 10 is a schematic view for describing the adjustment pattern of the recording apparatus according to an embodiment of the invention.

When the recording medium P is transported by a predetermined transport amount in the transport direction A, next, the reference pattern P1-2 indicated in light grey is recorded by the nozzles in the region Na of the nozzle row N of the recording head 4 while the recording head 4 is moved in the return direction B2 of the direction B, as shown in FIG. 10.

In FIG. 10, although five reference patterns P1-2 with seven stages in the direction following the transport direction A are formed along the return direction B2, all five of the reference patterns P1-2 are formed using the same nozzles in the region Na. However, the number of stages in the direction along the transport direction A or the number items in the direction along the return direction B2 of the reference pattern P1-2 can be changed, as appropriate, according to the number of nozzles of the nozzle row N, or the like.

Figure 11:
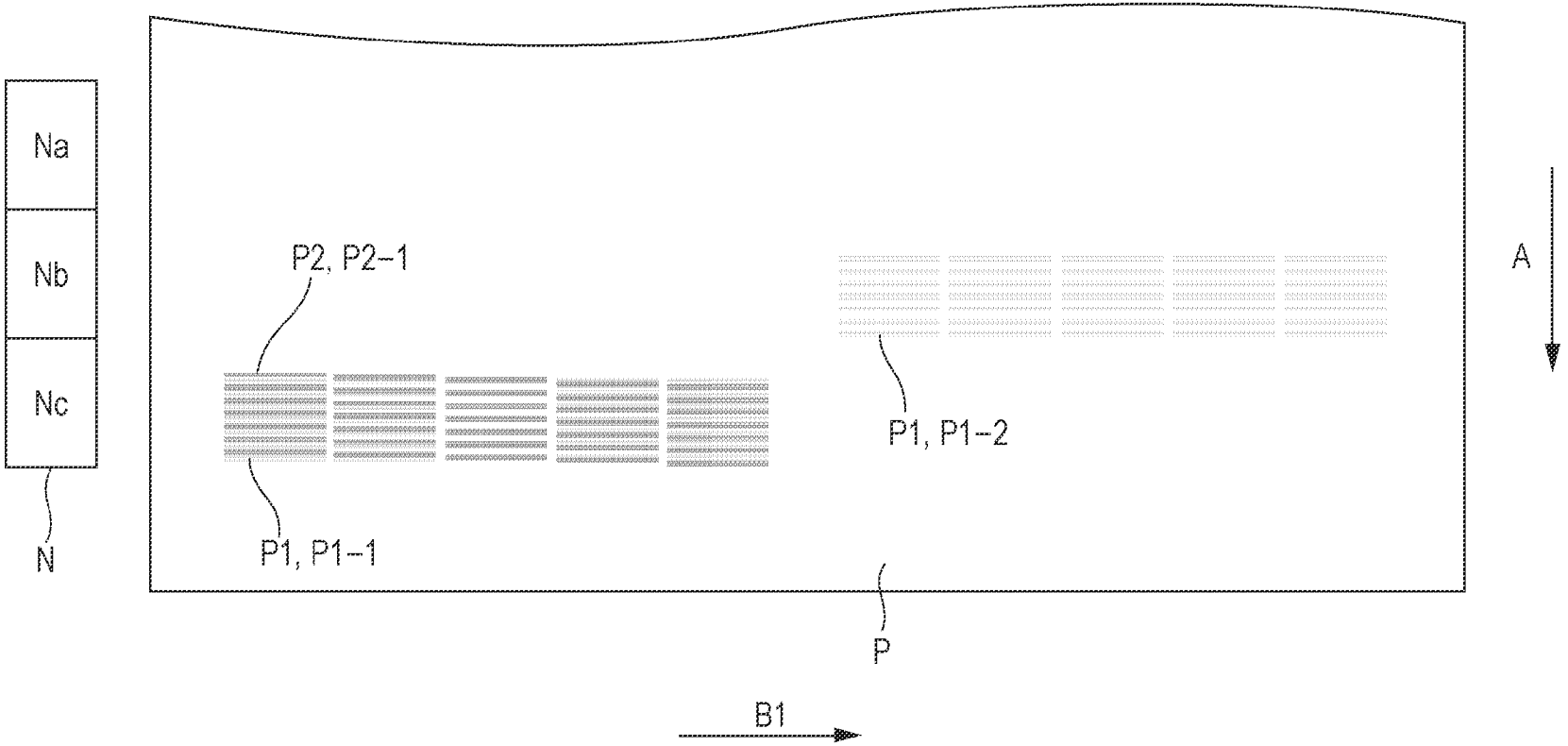
FIG. 11 is a schematic view for describing the adjustment pattern of the recording apparatus according to an embodiment of the invention.

When the recording medium P is transported by a predetermined transport amount in the transport direction A, next, the transport amount adjustment pattern P2-1 indicated in dark grey is recorded by the nozzles in the region Nc of the nozzle row N of the recording head 4 while the recording head 4 is moved in the outward direction B1, as shown in FIG. 11.

In FIG. 11, although five transport amount adjustment patterns P2-1 with seven stages in the direction following the transport direction A are formed along the outward direction B1, the five transport amount adjustment patterns P2-1 are each formed using different nozzles in the region Nc. In detail, the five transport amount adjustment patterns P2-1 are formed with the nozzles used shifted to the downstream side in the transport direction A in the region Nc toward the right side in the drawing. The transport amount adjustment pattern P2-1 in the center of the drawing from the five transport amount adjustment patterns P2-1 is assumed to overlap the reference pattern P1-1. In this way, the plurality of adjustment patterns is formed while changing the transport amount, the transport amount becomes the desired transport amount in a case where the transport amount adjustment pattern P2-1 overlaps the reference pattern P1-1 at the assumed position.

However, the number of stages in the direction along the transport direction A or the number of items in the direction along the outward direction B1 of the transport amount adjustment pattern P2-1 can be changed, as appropriate, according to the number of nozzles of the nozzle row N, or the like.

Figure 12:
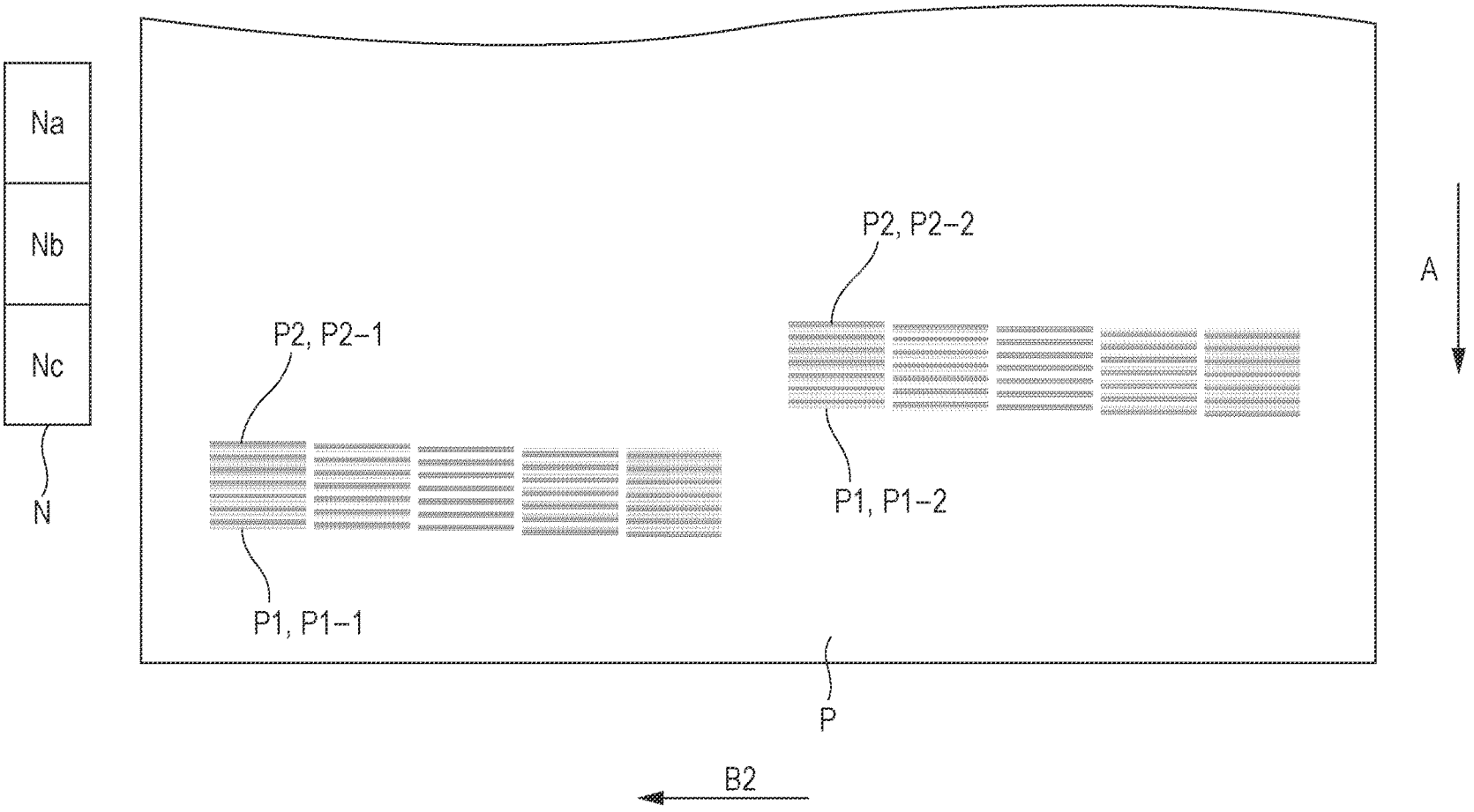
FIG. 12 is a schematic view for describing the adjustment pattern of the recording apparatus according to an embodiment of the invention.

When the recording medium P is transported by a predetermined transport amount in the transport direction A, next, the transport amount adjustment pattern P2-2 indicated in dark grey is recorded by the nozzles in the region Nc of the nozzle row N of the recording head 4 while the recording head 4 is moved in the return direction B2, as shown in FIG. 12.

In FIG. 12, although five transport amount adjustment patterns P2-2 with seven stages in the direction following the transport direction A are formed along the return direction B2, the five transport amount adjustment patterns P2-2 are each formed using different nozzles in the region Nc. In detail, the five transport amount adjustment patterns P2-2 are formed with the nozzles used shifted to the downstream side in the transport direction A in the region Nc toward the right side in the drawing. The transport amount adjustment pattern P2-2 in the center of the drawing from the five transport amount adjustment patterns P2-2 is assumed to overlap the reference pattern P1-2. In this way, the plurality of adjustment patterns is formed while changing the transport amount, the transport amount becomes the desired transport amount in a case where the transport amount adjustment pattern P2-2 overlaps the reference pattern P1-2 at the assumed position.

However, the number of stages in the direction along the transport direction A or the number items in the direction along the return direction B2 of the transport amount adjustment pattern P2-2 can be changed, as appropriate, according to the number of nozzles of the nozzle row N, or the like.

In this way, the adjustment pattern of the embodiment includes a reference pattern P1-1 that is an outward direction movement pattern and a transport amount adjustment pattern P2-1 that is an outward direction movement pattern, and along therewith, formed at a position overlapping the reference pattern P1-1 when viewed from the transport direction A by being formed after the recording medium P is transported by a predetermined transport amount after the reference pattern P1-1 is formed. A reference pattern P1-2 that is a return direction movement pattern and a transport amount adjustment pattern P2-2 that is a return direction movement pattern, and along therewith, formed at a position overlapping the reference pattern P1-2 when viewed from the transport direction A by being formed after the recording medium P is transported by a predetermined transport amount after the reference pattern P1-2 is formed are included.

Therefore, in light of a reference pattern made from the reference pattern P1-1 and the transport amount adjustment pattern P2-1 and a reference pattern made from the reference pattern P1-2 and the transport amount adjustment pattern P2-2, it is possible to simply apply an acceptable transport amount in both of transport after movement of the recording head 4 in the outward direction B1 and transport after movement of the recording head 4 in the return direction B2 and possible to simply adjust the transport precision of the recording medium P with high precision.

Since the patterns are formed at an overlapping position seen from the transport direction A, the configuration is able to easily compare of the reference pattern P1 and the transport amount adjustment pattern P2 in the transport direction A is easy, and to simply adjust the transport precision of the recording medium P with high precision.

In the embodiment, an average value of the optimal transport amount based on the reference pattern P1-1 and the transport amount adjustment pattern P2-1 and the optimal transport amount based on the reference pattern P1-2 and the transport amount adjustment pattern P2-2 is employed as an acceptable transport amount. However, there is no limitation to the average value.

Next, in order to be compared with the recording apparatus 1 of the embodiment, an example of forming the adjustment pattern in the recording apparatus in the related art is described.

Figure 17:
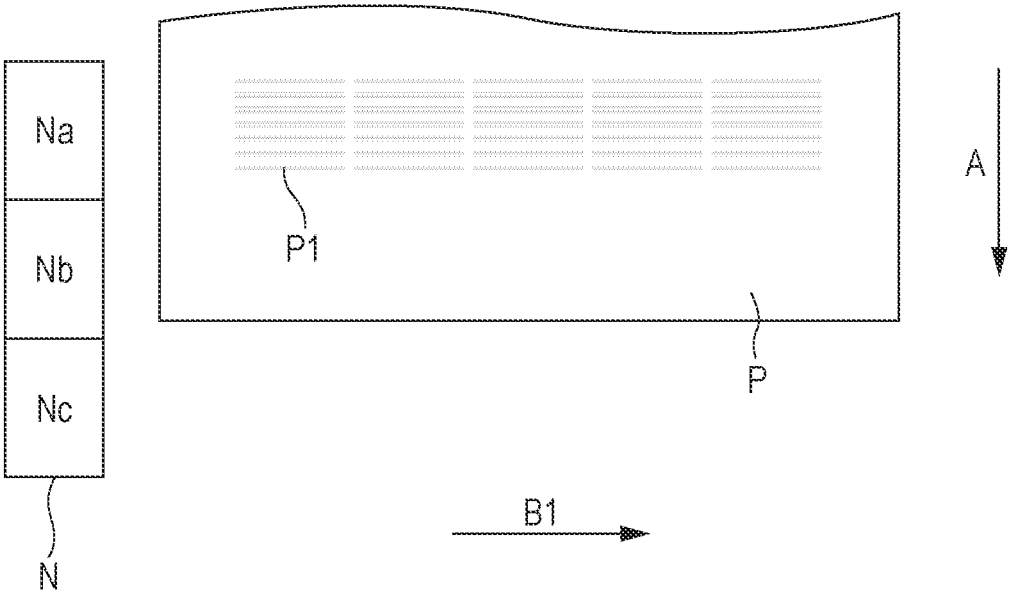
FIG. 17 is a schematic view for describing an adjustment pattern of a recording apparatus of the related art.
Figure 18:
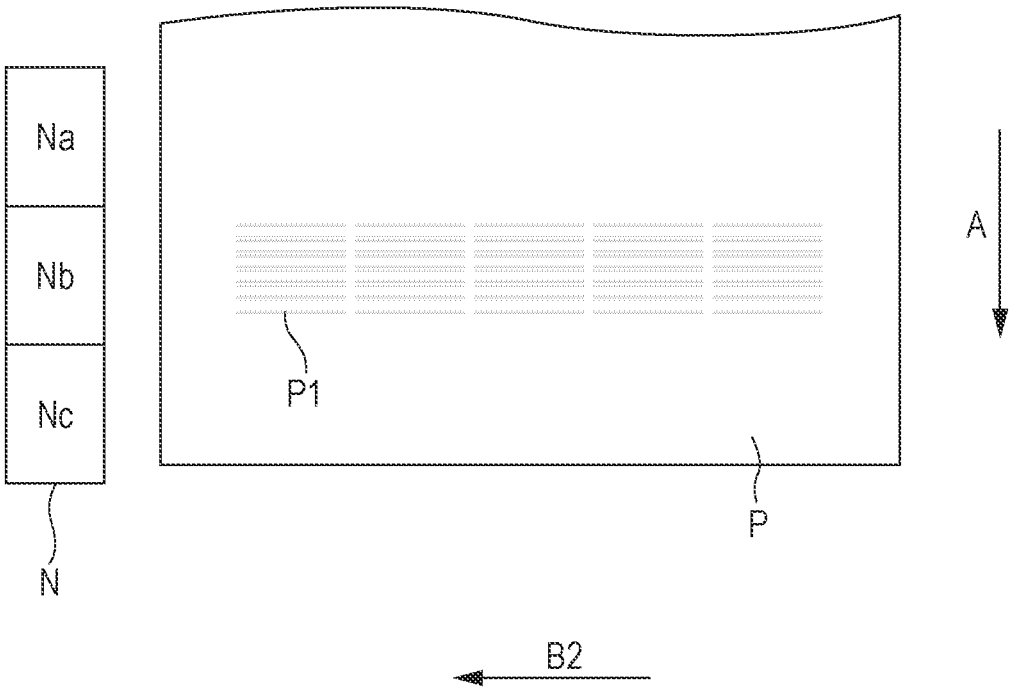
FIG. 18 is a schematic view for describing an adjustment pattern of a recording apparatus of the related art.
Figure 19:
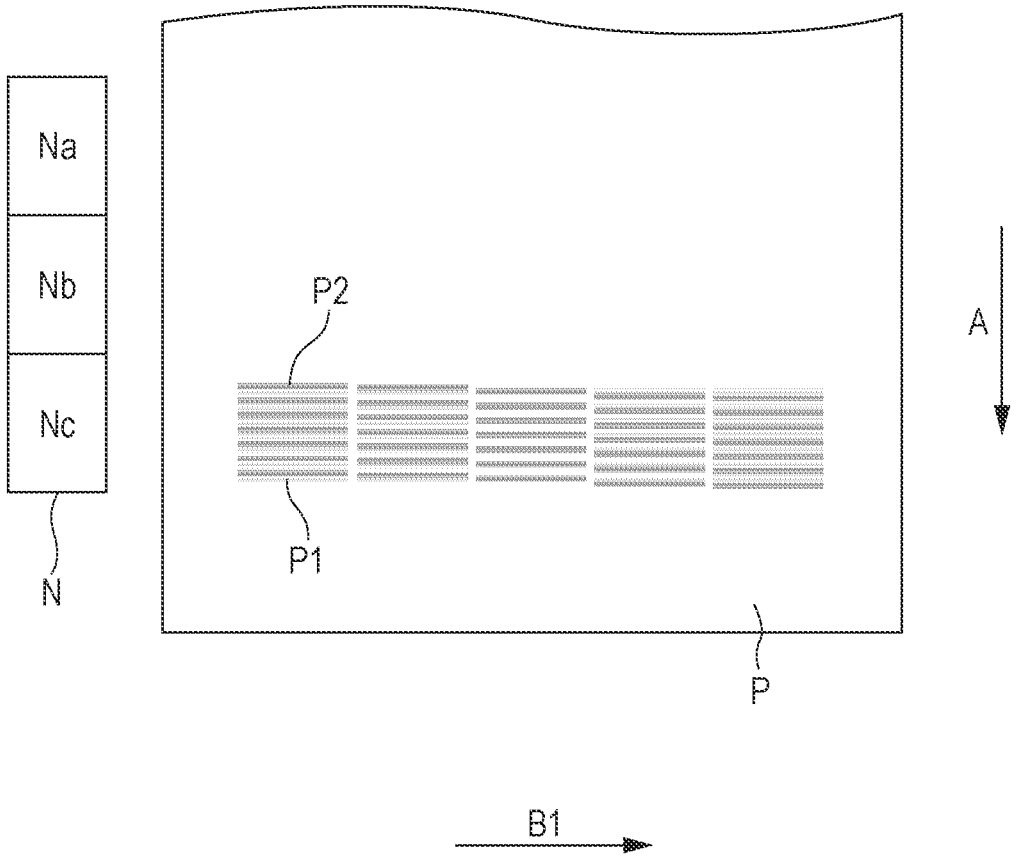
FIG. 19 is a schematic view for describing an adjustment pattern of a recording apparatus of the related art.

FIGS. 17 to 19 are schematic views for describing an example of forming the adjustment pattern for adjusting the transport amount of one transport of the recording medium P according to the intermittent transport in the recording apparatus of the related art.

Here, the recording apparatus of the related art is able to perform a so-called three-pass recording for forming an image at the same location on the recording medium P by causing the recording head to reciprocate one and a half times in the direction B, that is, according to a total of three times. The example of formation of the main adjustment pattern shown in FIGS. 17 to 19 is an example of adjustment of the transport amount when performing three-pass recording.

In the example of formation of the adjustment pattern of the related art, initially, the reference pattern P1 indicated in light grey is recorded by the nozzles of the region Na of the nozzle row N of the recording head 4 while the recording head 4 is moved in the outward direction B1 from the direction B, as shown in FIG. 17.

In the example of formation of the adjustment pattern of the embodiment, the nozzle row N is divided in three regions of region Na, region Nb, and region Nc, and the transport amount adjustment pattern P2 is formed using the region Nc at a position overlapping the reference pattern P1 formed using the region Na when seen from the transport direction A.

When the recording medium P is transported by a predetermined transport amount in the transport direction A, next, the recording head 4 is moved in the return direction B2, as shown in FIG. 18.

When the recording medium P is transported by a predetermined transport amount in the transport direction A, next, the transport amount adjustment pattern P2 indicated in dark grey is recorded by the nozzles in the region Nc of the nozzle row N of the recording head 4 while the recording head 4 is moved in the outward direction B1, as shown in FIG. 19.

In this way, in the recording apparatus of the related art, the adjustment pattern and the reference pattern P1 and the transport amount adjustment pattern P2 are formed in the same movement direction (outward direction B1) of the recording head 4, and the transport amount of the recording medium P is adjusted based on the adjustment pattern only. Therefore, in a case where the transport amount of the recording medium P is adjusted using such an adjustment pattern, even though the transport amount of the recording medium P after the recording head 4 is moved in the outward direction B1 is appropriate, the transport amount of the recording medium P after the recording head 4 moved in the return direction B2 is inappropriate. Specifically, by the transport amount of the recording medium P after the recording head 4 moves in the return direction B2 being inappropriate, stripes and the like arise along the direction B in the recorded image.

Next, the adjustment pattern of the embodiment is described in detail.

The reference pattern P1 and the transport amount adjustment pattern P2 are a plurality of linear patterns formed along the direction B in which the recording head 4 reciprocates. It is possible to adjust the transport amount of the recording medium P with a simple pattern.

Figure 13A:
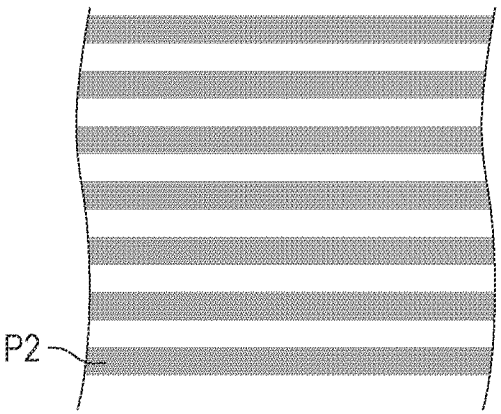
FIGS. 13A to 13C are schematic views for describing the adjustment pattern of the recording apparatus according to an embodiment of the invention.
Figure 13B:
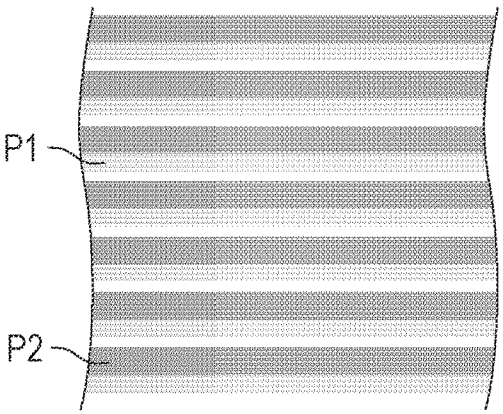
Figure 13C:
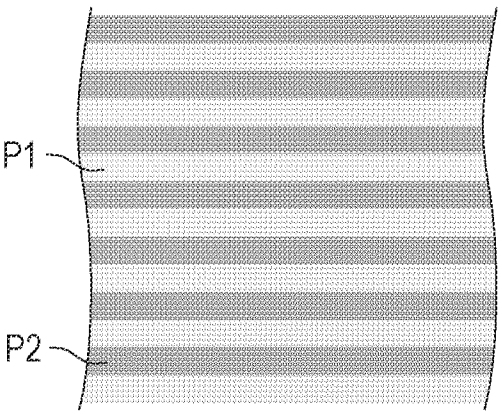

FIGS. 13A to 13C show adjustment patterns (reference pattern P1 and transport amount adjustment pattern P2) at three different positions from the five adjustment patterns formed lined up in the direction B In the state shown in FIGS. 7, 8, 11, and 12. In FIG. 13A to 14C, described later, the horizontal direction corresponds to the direction B, and the vertical direction corresponds to the transport direction A.

FIG. 13A shows a state in which the reference pattern P1 and the transport amount adjustment pattern P2 overlap.

FIG. 13B shows a state in which the reference pattern P1 and the transport amount adjustment pattern P2 are shifted. FIG. 13C shows a state in which the reference pattern P1 and the transport amount adjustment pattern P2 are shifted further than the state in FIG. 13B.

As above, the recording apparatus 1 of the embodiment is provided with a sensor 16 on a carriage 6, and is configured to be able to read the adjustment pattern. The sensor 16 is able to detect the optical density of the adjustment pattern based on the reflection intensity of light from the recording medium P, and the controller 11 is configured to be able to determine the transport amount of the recording medium P based on the optical density. Specifically, the controller 11 selects the pattern with the lowest optical density detected by the sensor 16, and is able to adjust the appropriate transport amount based on the information pertaining to the position thereof.

That is, a plurality of adjustment patterns is formed by changing the transport amount, the position of the pattern with the lowest optical density shown in FIG. 13A in the adjustment pattern of each transport amount is selected, and the appropriate transport amount is adjusted based on the transport amount of the adjustment pattern in which the position thereof is the desired position. However, there is no limitation on such a setting method of the transport amount of the recording medium P.

Figure 14C:
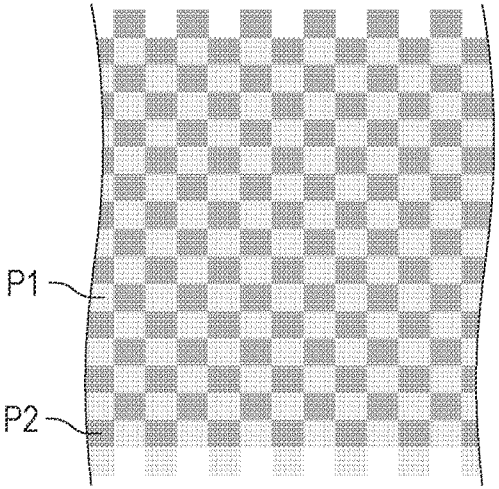
FIGS. 14A to 14C are schematic views for describing the adjustment pattern of the recording apparatus according to an embodiment of the invention.
Figure 14B:
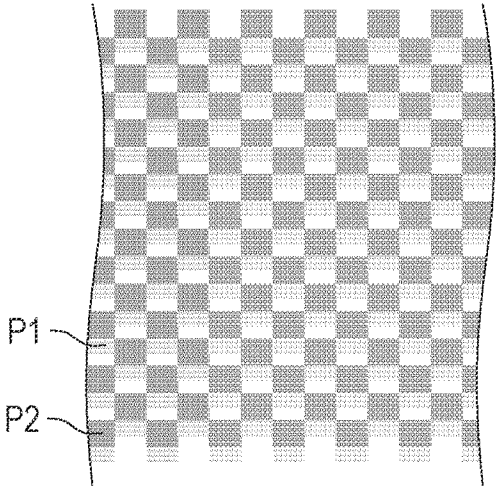
Figure 14A:
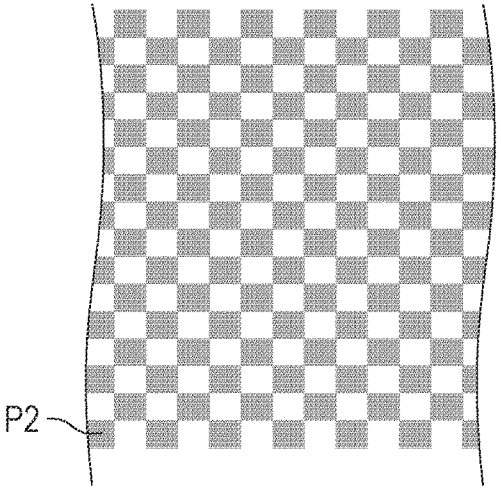

The recording apparatus 1 of the embodiment is able to use a plurality of grid-like patterns formed in the mutually different direction B and direction that intersects the direction B at the reference pattern P1 and the transport amount adjustment pattern P2 as shown in FIGS. 14A to 14C in place of the plurality of linear patterns formed along the direction B as shown in FIG. 13. Even in such a separate simple pattern, it is possible to adjust the transport amount of the recording medium P with the same method as the case of using the adjustment pattern shown in FIGS. 13A to 13C.

FIG. 14A shows a state in which the reference pattern P1 and the transport amount adjustment pattern P2 overlap.

FIG. 14B shows a state in which the reference pattern P1 and the transport amount adjustment pattern P2 are shifted. FIG. 14C shows a state in which the reference pattern P1 and the reciprocation adjustment pattern P2 are shifted further than the state in FIG. 14B.

In the embodiment, although an example is provided of performing recording the adjustment pattern (reference pattern P1 and the transport amount adjustment pattern P2) with one recording scan (so-called one pass) in the direction B of the recording head 4, it is also possible for the controller 11 to control the recording of the reference pattern P1 and the transport amount adjustment pattern P2 with each of a plurality of passes.

The recording apparatus 1 of the embodiment is able to adjust the transport amount of the recording medium P using the adjustment pattern as shown that FIGS. 13A to 13C and 14A to 14C. It is possible to adjust the transport amount of the recording medium P by executing the example of the formation of the adjustment pattern shown in FIGS. 4 to 8, and 9 to 12 while changing the transport amount of the recording medium P.

The recording apparatus 1 of the embodiment is able to form a plurality of adjustment patterns with the predetermined transport amount changed according to the control of the controller 11. Therefore, the configuration is able to reduce the load on a user pertaining to adjustment patterns being formed many times over while changing the transport amount.

Next, a specific example in which formation of the adjustment pattern is executed a plurality of times while changing the transport amount of the recording medium P is described.

FIGS. 15A to 16B are conceptual diagrams of the adjustment patterns for describing an execution of examples different to one another in which formation of the adjustment pattern is executed a plurality of times while changing the transport amount of the recording medium P.

In FIGS. 15A to 16B, the vertical direction corresponds to the transport direction A and, along therewith, to the difference in the transport amount of the recording medium P, and the horizontal direction corresponds to the direction B and, along therewith, to the difference in the used nozzle from the nozzle row N. In FIGS. 7 to 12, although an example of the formation of an adjustment pattern in which five adjustment patterns are lined up in the direction B is given, FIGS. 15A to 16B are examples of the formation of an adjustment pattern in which eleven adjustment patterns are lined up in the direction B.

FIGS. 15A to 16C correspond to a state in which the adjustment patterns according to the reference pattern P1 and the transport amount adjustment pattern P2 shown in FIGS. 7, 8, 11, and 12 are lined up in the vertical direction (the lower side in the drawing is the downstream side in the transport direction A) while changing the transport amount of the recording medium P. Each of the five adjustment patterns lined up in the vertical direction is formed with the nozzles used shifted to the downstream side in the transport direction A toward the right side in the drawing in the eleven adjustment patterns lined up in the horizontal direction.

Here, the recording apparatus 1 of the embodiment is configured to be able to transport the recording medium P by a length in which the transport amount with the length (a/n)L is added to or subtracted from the reference transport amount, where the distance between neighboring nozzles in the nozzle row N is L, n is an integer, and a is an integer of 0 to n or less. The phrase "reference transport amount" refers to the transport amount that is the reference for determining a transport amount of one transport during the intermittent transport of the recording medium P, and is the transport amount at which the transport precision is able to be held. In the embodiment, the length corresponds to the length mL that is the integer m multiple of the distance L between neighboring nozzles of the nozzle row N.

In other words, the recording apparatus 1 of the embodiment is configured to be able to transport the recording medium P by at least one of the sum (m+a/n)L and the difference (m−a/n)L of the length mL that is the integer m multiple of the distance L between neighboring nozzles of the nozzle row N as the reference transport amount and the length (a/n)L in which a second integer a equal to or less than a first integer n is multiplied by the length in which the distance between neighboring nozzles of the nozzle row N is divided by the first integer n.

In order to adjust the minute transport amount with a minute length that is less than the distance L between neighboring nozzles of the nozzle row N, performing transport of the recording medium P with a length that is the minute length itself is considered. However, when the transport of the recording medium P with a length that is the minute length itself is performed, errors in the transport amount tend to increase.

The length (a/n)L in which the second integer a equal to or less than the first integer n is multiplied by the length in which the distance L between neighboring nozzles of the nozzle row N is divided by the first integer n corresponds to the minute length.

Accordingly, by the recording apparatus 1 of the embodiment transporting the length of at least one of the sum (m+a/n)L and difference (m−a/n)L of the length mL that is an integer m multiple of the distance L between neighboring nozzles of the nozzle row N and the minute distance (a/n)L, the transport amount does not become the minute distance, and thus errors in the transport amount can be suppressed. By forming the adjustment pattern with the second integer a in numerical order modified from 0 to the first integer n, precise adjustment of the transport amount with a minute length of less than the distance L between neighboring nozzles of the nozzle row N can be performed.

In the embodiment, the integer n is 2, the integer a is 0, 1, and 2. Therefore, the transport amount according to the formation of the adjustment pattern is, in increasing order, (m−1)L, (m−½)L, mL, (m+½)L, and (m+1)L, and corresponds to the numerical values of −2, −1, 0, +1, and +2 lined up in the vertical direction in FIGS. 15A to 16B.

Figure 15A:
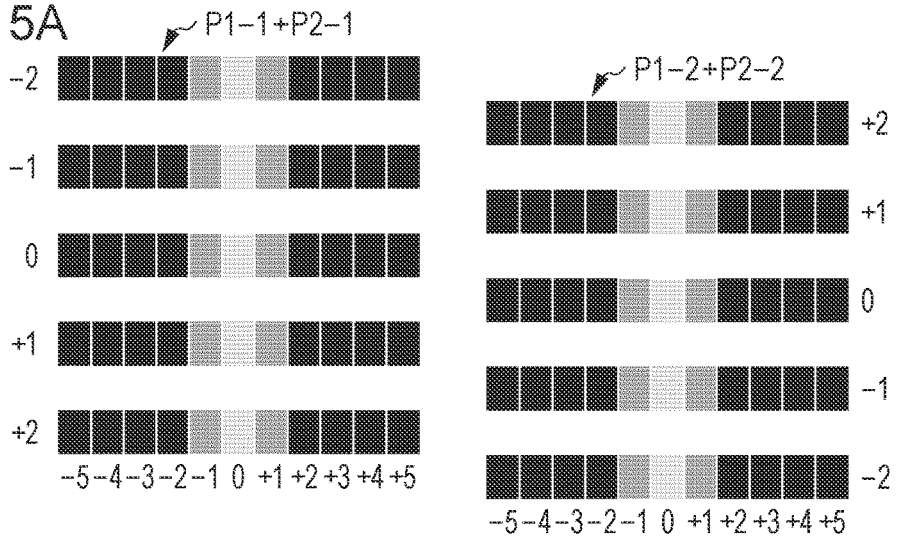
FIGS. 15A to 15C are schematic views for describing the adjustment pattern of the recording apparatus according to an embodiment of the invention.
Figure 15B:
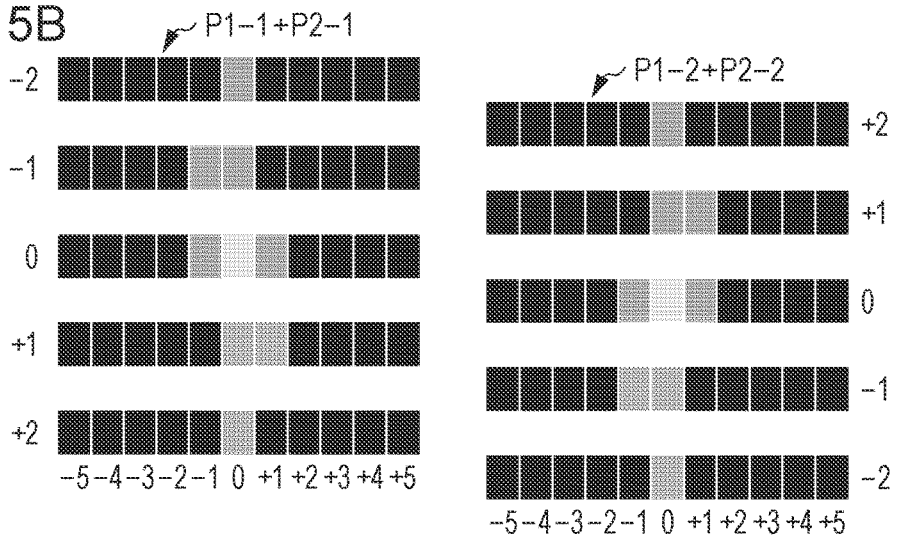
Figure 15C:
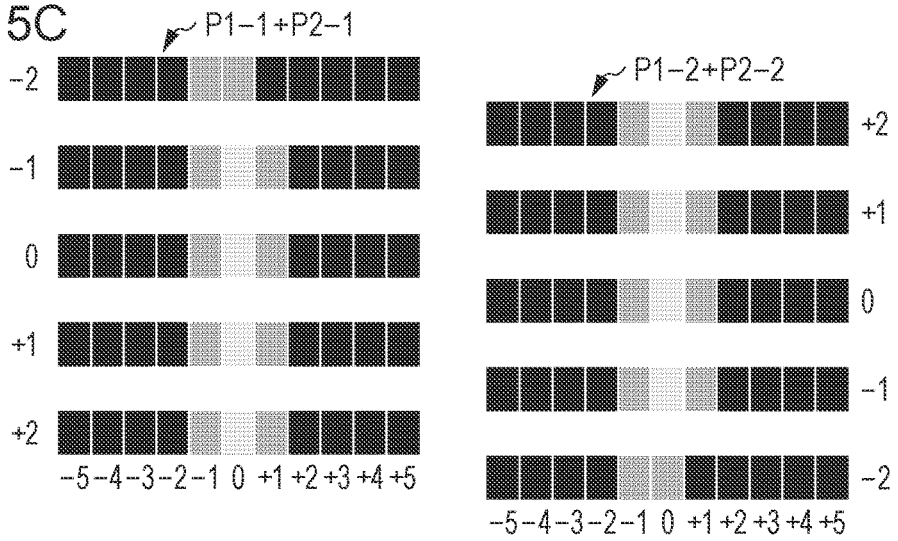

Firstly, an execution example shown in FIGS. 15A to 15C is described.

Here, FIG. 15A is a drawing showing an example of the adjustment of the adjustment pattern in which the optical density of the adjustment pattern is lowest at a position where the numerical value lined up in the horizontal direction is 0 even at each position (each position where the numerical value is −2, −1, +1, and +2 lined up in the vertical direction) at which the transport amount is modified by the minute length L(a/n) at the position, in addition to the position of the predetermined transport amount (position at which the numerical value lined up in the vertical direction is 0), is assumed.

That is, in a case of using example of adjustment of such an adjustment pattern, the transport amount of the adjustment pattern among the five adjustment patterns where the optical density of the adjustment pattern is lowest at a position where the numerical value lined up in the horizontal direction is 0 corresponds to the appropriate transport amount.

FIG. 15B is an example of the formation of the adjustment pattern actually formed on the recording medium P based on the example of the adjustment of the adjustment pattern shown in FIG. 15A. In a case where the adjustment pattern is formed as in FIG. 15B, the adjustment pattern among the five adjustment patterns lined up in the vertical direction at the position at which the numerical value lined up in the vertical direction is 0 has the lowest optical density of the adjustment pattern at the position where the numerical value lined up in the horizontal direction is 0. That is, the transport amount (corresponds to the reference transport amount mL itself) at the position where the numerical value lined up in the vertical direction is 0 corresponds to the appropriate transport amount.

FIG. 15C is another example of the formation of the adjustment pattern actually formed on the recording medium P based on the example of the adjustment of the adjustment pattern shown in FIG. 15A. In a case where the adjustment pattern is formed as in FIG. 15C, the transport amount at which the optical density of the adjustment pattern at the position where the numerical value lined up in the horizontal direction is 0 is the lowest is the position where the numerical value line up in the vertical direction is −1, 0, +1, and +2 and a plurality of positions. That is, the optical density at the position where the numerical value lined up in the horizontal direction is 0 in the adjustment pattern where the numerical value is −1, 0, +1, and 2 lined up in the vertical direction is similarly the lowest. In such a case, it is difficult to determine whether the transport amount of whichever adjustment pattern among the five adjustment patterns lined up in the vertical direction is the adjustment pattern in which the numerical value lined up in the vertical direction is −1, 0, +1, and +2 is appropriate. In this way, in cases where the appropriate transport amount is difficult to determine, the execution example shown in FIGS. 16A and 16B may be executed.

Figure 16A:
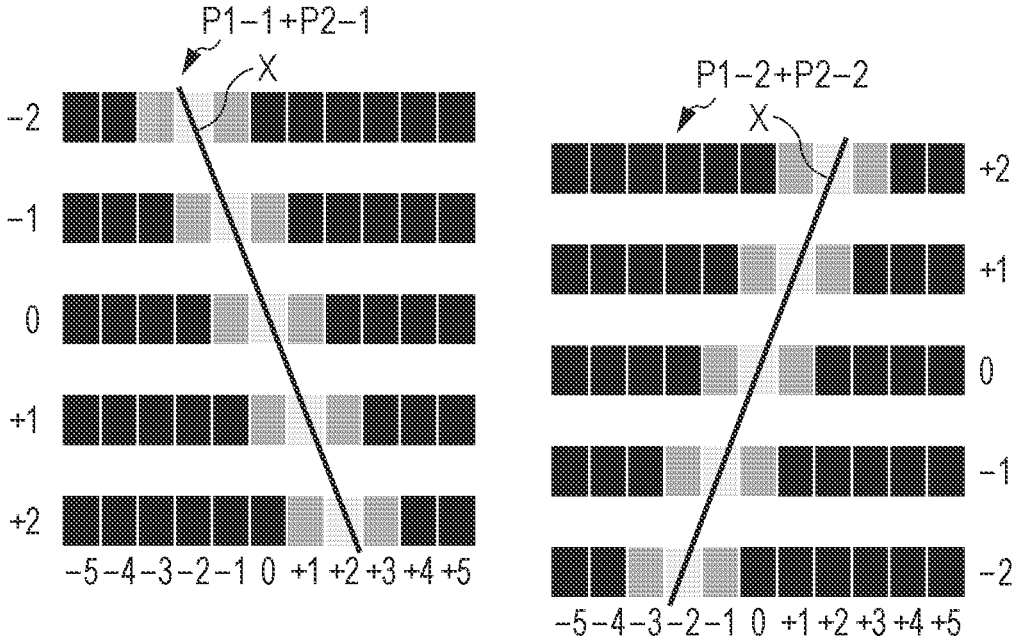
FIGS. 16A and 16B are schematic views for describing the adjustment pattern of the recording apparatus according to an embodiment of the invention.

Here, FIG. 16A is a drawing showing an example of the adjustment of the adjustment pattern in which it is assumed that the optical density of the adjustment pattern is the lowest at the position where the numerical value lined up in the horizontal direction is 0 at the position at which the numerical value lined up in the vertical direction is 0, and the optical density of the adjustment pattern at a position where the numerical value lined up in the horizontal direction is −2, −1, +1, and +2 is the lowest at a position where the numerical value lined up in the vertical direction is −2, −1, +1, and +2.

In the embodiment, such an adjustment pattern is used, and the transport amount of the adjustment pattern among the five adjustment patterns where the optical density of the adjustment pattern is lowest at a position where the numerical value lined up in the horizontal direction is 0 is made the appropriate transport amount.

Figure 16B:
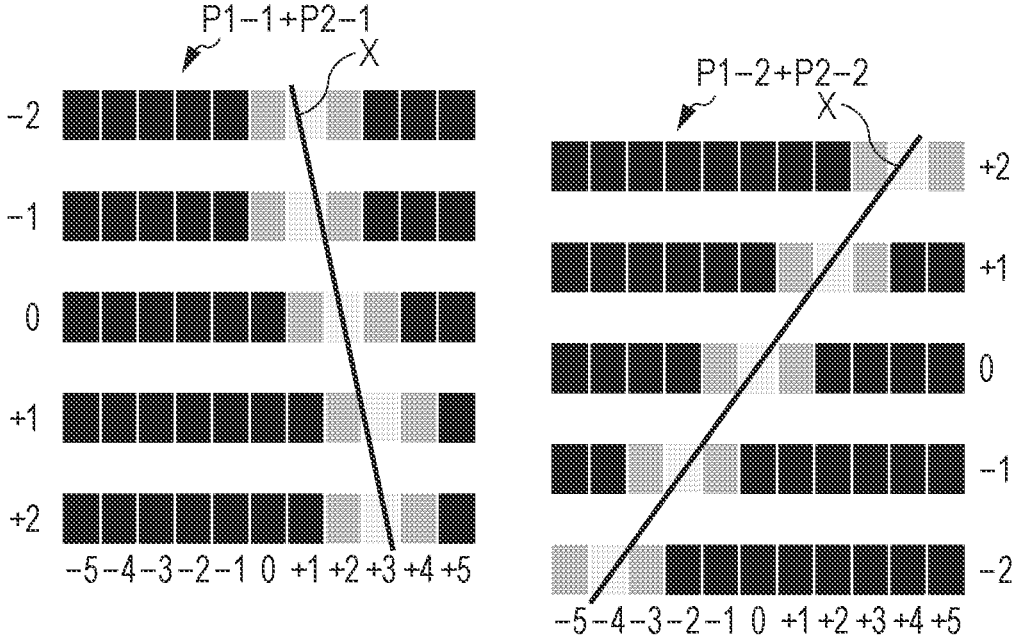

In a case where the adjustment pattern is formed based on the example of the adjustment of the adjustment pattern shown in FIG. 16A and a case where the adjustment pattern is formed as shown in FIG. 16A, the transport amount of the adjustment pattern among the five adjustment patterns lined up in the vertical direction at the position where the numerical value lined up in the horizontal direction is 0 is the appropriate transport amount. Specifically, the straight line X that connects the pattern in which the optical density is lowest in each of the five adjustment patterns lined up in the vertical direction as shown in the FIGS. 16A and 16B is obtained, and the transport amount of the pattern (among the five adjustment patterns lined up in the vertical direction) where the straight line X passes through the 0 position in the numerical values lined up in the horizontal direction is the appropriate transport amount.

In this way, the appropriate transport can be simply determined by obtaining the straight line X that connects the pattern with the lowest optical density in each of the five adjustment patterns lined up in the vertical direction, and being able to determine the appropriate transport amount based on the straight line X. In a case where the adjustment pattern is formed as shown in FIG. 16A, the appropriate transport amount is the transport amount at the position where the numerical value lined up in the vertical direction is 0, and is the reference transport amount mL itself.

In other words, a plurality of adjustment patterns shown in FIG. 16A is arranged in both of the direction B and the transport direction A, and the position of the adjustment pattern in which the appropriate adjustment position in the direction B is assumed is arranged shifted when viewed from the transport direction A.

It is possible to easily determine the appropriate transport amount compared to a reference pattern shown in FIG. 15A formed in a straight line without shifting the position of the adjustment pattern in which the appropriate adjustment position in the direction B is assumed seen from the transport direction A.

Therefore, erroneous determination of the appropriate transport amount can be suppressed, and the transport precision of the recording medium P can be adjusted with a particularly high precision.

There is no limitation to an adjustment method that adjusts the transport amount based on the straight line X after obtaining the straight line X. However, an adjustment pattern in which the position with the lowest optical density shown in FIG. 16A is arranged shifted further when seen from the transport direction A than the adjustment pattern formed so that the position where the optical density as shown in FIG. 15A is lowest follows the transport direction. Since the slope of the straight line X is steep, even if the appropriate transport amount is to be determined when the straight line X is obtained in the adjustment pattern as shown in FIG. 15A, it is easier to determine the appropriate transport amount of the adjustment pattern as shown in FIG. 16A.

The recording apparatus 1 of the embodiment forms two adjustment patterns of an adjustment pattern configured by the reference pattern P1-1 and the transport amount adjustment pattern P2-1 and an adjustment pattern configured by the reference pattern P1-2 and the transport amount adjustment pattern P2-2, as shown in FIGS. 15A to 16C, and FIGS. 8 and 12, and the like. In the adjustment pattern shown in FIG. 16A, the slope of the straight line X that connects the pattern with the lowest optical density of the two adjustment patterns is reversed.

Due to fluctuations and the like of the remainder of the recording medium P, there are cases where the transport load fluctuates, and the adjustment pattern formed based on the adjustment pattern shown in FIG. 16A becomes as shown in FIG. 16B. That is, there are cases where the slope of the straight line X in the two adjustment patterns fluctuates.

However, since the slope of the straight line X of the adjustment of the adjustment pattern shown in FIG. 16A is reversed, in a case where the slope of the straight line X fluctuates, the slope of one of the two adjustment patterns becomes steep, and the slope of the other becomes shallow. Therefore, even in cases where the slope of the straight line X fluctuates, one (one where the slope of the straight line X becomes shallow) of the two adjustment patterns passes through the point where the optical density is lowest at the point where the numerical value lined up in the horizontal direction is 0. In other words, the straight line X of at least one of the two adjustment patterns passes through the point where the numerical value lined up in the horizontal direction is 0.

In this way, it is possible to adjust the transport amount with the straight line X as a reference in a case where the only the straight line X of one of the two adjustment patterns passes through the position where the numerical value lined up in the horizontal direction is 0. That is, in a case as shown in FIG. 16B, it is possible for the transport amount (corresponds to the reference transport amount mL itself) of the adjustment pattern at the position where the numerical value lined up in the vertical direction is 0 to be the appropriate transport amount based on the adjustment pattern on the right side in the drawing from the two adjustment patterns.

In a case where there is a predetermined difference or more in the size of the slope of the straight line X of the two adjustment patterns, it is preferable to employ a transport amount obtained from the pattern in which the slope of the straight line X becomes shallow. However, in a case where the difference in the slopes of the straight line X of the two adjustment patterns is small, an average value of the transport amount obtained from both patterns may be taken.

The invention is not limited to the embodiments described above and can be changed in various ways within the aspects described in the aspects, and the modifications should be construed as being included in the invention.

Above, the invention was described in detail based specific embodiments of the invention. Here, the invention will be summarized again and described.

According to a first aspect of the invention, a liquid discharging apparatus is a liquid discharging apparatus 1 provided with a discharging unit 4 that includes a nozzle row N that discharges a liquid, and that is able to reciprocate in a first direction B that intersects the nozzle row N, and a transport unit 5 that is able to intermittently transport a medium P in a second direction A that intersects the first direction B, the liquid discharging apparatus 1 is able to form a reference pattern that adjusts transport amount of one transport in the intermittent transport, and the adjustment pattern is formed using both of an outward direction movement pattern formed while moving the discharging unit 4 in the outward direction B1 of the first direction B and a return direction movement pattern formed while moving the discharging unit 4 in the return direction B2 of the first direction B.

According to the aspect, the adjustment pattern is formed using both of the outward direction movement pattern formed while moving the discharging unit 4 in the outward direction B1 and the return direction movement pattern formed while moving the discharging unit 4 in the return direction B2. Therefore, by adjusting the transport amount of one transport performed after movement in the outward direction B1 of the discharging unit 4 and the transport amount of one transport performed after movement in the return direction B2 of the discharging unit 4 to a shared transport unit based on the adjustment pattern, an acceptable transport amount can be simply adopted in both transport after movement in outward direction B1 of the discharging unit 4 and transport after movement in the return direction B2 of the discharging unit 4. Accordingly, the transport precision of the medium P can be simply adjusted with a high precision.

According to a second aspect of the invention, in the liquid discharging apparatus 1 of the first aspect, the adjustment pattern includes a reference pattern P1 formed from one of the outward direction movement pattern and the return direction movement pattern, and a transport amount adjustment pattern P2 formed after the medium P is transported a predetermined amount after the reference pattern P1 is formed, and along therewith formed from the other of the outward direction movement pattern and the return direction movement pattern.

According to this aspect, the adjustment pattern is formed using both the outward direction movement pattern and the return direction movement pattern. Therefore, an acceptable transport amount can be simply adopted in both of transport after movement in the outward direction B1 of the discharging unit 4 and transport after movement in the return direction B2 of the discharging unit 4. Accordingly, the transport precision of the medium P can be simply adjusted with a high precision.

According to third aspect of the invention, in the liquid discharging apparatus 1 of the first aspect, the adjustment pattern P1 includes a transport amount adjustment pattern P2 formed after the medium P is transported a predetermined amount after the reference pattern P1 formed from the outward direction movement pattern and the reference pattern P1 formed from the outward direction movement pattern are formed, and a transport amount adjustment pattern P2 formed after the medium P is transported a predetermined amount after the reference pattern P1 formed from the return direction movement pattern and the reference pattern P1 formed from the return direction movement pattern are formed.

According to this aspect, the adjustment pattern is formed using both the outward direction movement pattern and the return direction movement pattern. Therefore, an acceptable transport amount can be simply adopted in both of transport after movement in the outward direction B1 of the discharging unit 4 and transport after movement in the return direction B2 of the discharging unit 4. Accordingly, the transport precision of the medium P can be simply adjusted with a high precision.

According to a fourth aspect of the invention, in the liquid discharging apparatus 1 of the second or third aspect, a plurality of the adjustment patterns is formed with the nozzle used in the nozzle row N shifted in at least one of the outward direction movement pattern and the return direction movement pattern with respect to the reference pattern.

According to the aspect, a plurality of the adjustment patterns is formed with the nozzle used in the nozzle row shifted in at least one of the outward direction movement pattern and the return direction movement pattern with respect to the reference pattern. Therefore, it is possible to simply configure an adjustment pattern for performing adjustment of the transport amount.

According to a fifth aspect of the invention, in the liquid discharging apparatus 1 of any one of the second to fourth aspects, a plurality of reference patterns is formed with the predetermined transport amount modified.

According to the aspect, a plurality of adjustment patterns is formed with the predetermined transport amount changed. Therefore, it is possible to reduce the load on a user pertaining to adjustment patterns being formed many times over while changing the transport amount.

According to a sixth aspect of the invention, in the liquid discharging apparatus 1 of any one of the second to fifth aspects, the transport amount adjustment pattern P2 is formed at a position overlapping the reference pattern P1 when seen from the second direction A.

According to the aspect, the transport amount adjustment pattern P2 is formed at a position that overlaps the reference pattern P1 when viewed from the second direction A. Therefore, comparison of the reference pattern P1 and the transport amount adjustment pattern P2 in the transport direction A of the medium P becomes easy, and the transport precision of the medium P can be simply adjusted with high precision.

According to a seventh aspect of the invention, in the liquid discharging apparatus 1 of any one of the second to sixth aspects, the predetermined transport amount is at least one of a sum $(m+a/n)L$ and a difference $(m-a/n)$ of a reference transport amount mL and a length $(a/n)L$ in which a second integer a equal to or less than a first integer n is multiplied by a length in which the distance L between neighboring nozzles of the nozzle row N is divided by the first integer n.

Although performing the transport of the medium P with a minute length is considered in order to adjust the precise transport amount with a minute length with less than the distance L between neighboring nozzles of the nozzle row N, errors in transport amounts when the transport of the medium P with minute distance is performed tend to increase.

According to the aspect, the predetermined transport amount is at least one of the sum $(m+a/n)L$ and the difference $(m-a/n)L$ of the reference transport amount mL and a length $(a/n)L$ in which a second integer a equal to or less than a first integer n is multiplied by a length in which the distance L between neighboring nozzles of the nozzle row N is divided by the first integer n. Here, the length $(a/n)L$ in which the second integer a equal to or less than the first integer n is multiplied by the length $(a/n)L$ in which the distance L between neighboring nozzles of the nozzle row N is divided by the first integer n corresponds to the minute length. Accordingly, by the recording apparatus 1 of the embodiment transporting the length of at least one of the sum $(m+a/n)L$ and difference $(m-a/n)L$ of the reference transport amount mL such as an integer m multiple of the distance L between neighboring nozzles of the nozzle row N and the minute distance $(a/n)L$, the transport amount does not become the minute distance, and thus errors in the transport amount can be suppressed. By forming the adjustment pattern with the second integer a in numerical order modified from 0 to the first integer n, precise adjustment of the transport amount with a minute length of less than the distance L between neighboring nozzles of the nozzle row N can be performed.

The phrase "reference transport amount" refers to the reference length in order to determine the predetermined transport amount, and is a transport amount of one transport in the intermittent transport of the medium P at which the transport precision is able to be held.

According to an eighth aspect of the invention, in the liquid discharging apparatus 1 according to the seventh aspect, a plurality of the adjustment patterns is formed in the first direction B by forming a plurality of the transport amount adjustment patterns P2 by changing each nozzle used in the nozzle row N after a plurality of reference patterns P1 is formed in the first direction B, and, along therewith, a plurality thereof is formed in the second direction A while changing the predetermined transport amount by changing the second integer, and the transport amount adjustment pattern P2 formed using the same nozzle as the nozzle with which the reference pattern P1 is formed is arranged shifted when viewed from the second direction A in the plurality of adjustment patterns formed in the second direction A.

According to the aspect, a plurality of adjustment patterns is formed in the second direction A with the predetermined transport amount changed by changing the second integer a, and, along therewith, a plurality is formed in the first direction B by forming a plurality of transport amount adjustment patterns P2 in the first direction B while changing each of the nozzles used after the plurality of reference patterns P1 is formed in the first direction B. In the plurality of adjustment patterns formed in the second direction A, the transport amount adjustment pattern P2 formed using the same nozzle as the nozzle with which the reference pattern P1 is formed is arranged shifted when viewed from the second direction A. That is, a plurality of adjustment patterns is arranged in both the first direction B and the second direction A, and the position of the adjustment pattern in which the appropriate adjustment position in the first direction B is assumed is arranged shifted when viewed from the second direction A.

By using such an aspect as described above it is possible to easily determine the appropriate transport amount compared to a case of forming the adjustment pattern linearly without shifting the position of the adjustment pattern in which the appropriate adjustment position in the first direction B is assumed when seen from the second direction A.

Therefore, erroneous determination of the appropriate transport amount can be suppressed, and the transport precision of the medium P can be adjusted with a particularly high precision.

According to a ninth aspect of the invention, there is provided a transport amount adjustment method that is able to be executed using a liquid discharging apparatus 1 provided with a discharging unit 4 that has nozzle rows N that discharge a liquid and is able to be reciprocated in a first direction B intersecting the nozzle rows N, and a transport unit 5 that is able to intermittently transport a medium P in a second direction A that intersects the first direction B, the method including forming an adjustment pattern by which a transport adjustment amount of one transport in the intermittent transport is adjusted is formed while moving the discharging unit 4 in both of an outward direction B1 in the first direction B and a return direction B2 in the first direction B; and adjusting the transport amount of one transport performed after moving the discharging unit 4 in the outward direction B1 and the transport amount of one transport performed after moving the discharging unit 4 in the return direction B2 based on the adjustment pattern to a common transport amount.

According to the aspect, the adjustment pattern is formed while moving the discharging unit 4 in both of the outward direction B1 and the return direction B2. The transport amount of one transport performed after movement in outward direction B1 of the discharging unit 4 and the transport amount of one transport performed after movement in the return direction B2 of the discharging unit 4 are adjusted to the shared transport amount based on the adjustment pattern. Therefore, an acceptable transport amount can be simply adopted in both of transport after movement in the outward direction B1 of the discharging unit 4 and transport after movement in the return direction B2 of the discharging unit 4. Accordingly, the transport precision of the medium P can be simply adjusted with a high precision.

What is claimed is:

1. A liquid discharging apparatus, comprising:

a discharging unit that includes a nozzle row comprising a plurality of nozzles configured to discharge a liquid, the discharging unit being configured to reciprocate in an outward direction and a return direction opposing the outward direction, the outward and return directions being transverse to the nozzle row; and a transport unit configured to intermittently transport a medium in a direction transverse to the outward and return directions, wherein the liquid discharging apparatus is configured to form at least one adjustment pattern for adjusting a transport amount of each individual transport during the intermittent transport, and wherein the liquid discharging apparatus is configured to form the at least one adjustment pattern such that the at least one adjustment pattern includes:

at least one first reference pattern formed while moving the discharging unit in the outward direction, at least one second reference pattern formed while moving the discharging unit in the return direction, at least one first transport amount adjustment pattern formed after the medium is transported a predetermined amount after the at least one first reference pattern is formed, wherein the at least one first transport amount adjustment pattern is formed using a region of he nozzle row different than that used to form the at least one first reference pattern, and at least one second transport amount adjustment pattern formed after the medium is transported a predetermined amount after the at least one second reference pattern is formed, wherein the at least one second transport amount adjustment pattern is formed using a region of the nozzle row different than that used to form the at least one second reference pattern.

2. The liquid discharging apparatus according to claim 1, wherein the liquid discharging apparatus is configured to form the first transport amount adjustment pattern at a position overlapping the first reference pattern in the direction transverse to the outward and return directions, and wherein the liquid discharging apparatus is configured to form the second transport amount adjustment pattern at a position overlapping the second reference pattern in the direction transverse to the outward and return directions.

3. The liquid discharging apparatus according to claim 1, wherein the at least one first transport amount adjustment pattern is formed while moving the discharging unit in the return direction, and wherein the at least one second transport amount adjustment pattern is formed while moving the discharging unit in the outward direction.

4. The liquid discharging apparatus according to claim 1, wherein the at least one first transport amount adjustment pattern is formed while moving the discharging unit in the outward direction, and wherein the at least one second transport amount adjustment pattern is formed while moving the discharging unit in the return direction.

5. The liquid discharging apparatus according to claim 1, wherein the at least one first reference pattern comprises a plurality of first reference patterns, wherein the at least one second reference pattern comprises a plurality of second reference patterns, wherein the at least one first transport amount adjustment pattern comprises a plurality of first transport amount adjustment patterns, and wherein the at least one second transport amount adjustment pattern comprises a plurality of second transport amount adjustment patterns.

6. The liquid discharging apparatus according to claim 5, wherein the liquid discharging apparatus is configured such that:

a nozzle used to form a first one of the first transport amount adjustment patterns is different from a nozzle used to form a second one of the first transport amount adjustment patterns, and a nozzle used to form a first one of the second transport amount adjustment patterns is different from a nozzle used to form a second one of the seecond transport amount adjustment patterns.

7. The liquid discharging apparatus according to claim 1, wherein each predetermined transport amount is at least one of a sum and a difference of (i) a corresponding reference transport amount and (ii) a length in which a second integer equal to or less than a first integer is multiplied by a length in which the distance between neighboring nozzles of the nozzle row is divided by the first integer.

8. The liquid discharging apparatus according to claim 7, wherein the liquid discharging apparatus is configured to form the at least one adjustment pattern such that the at least one adjustment pattern includes a plurality of adjustment patterns formed in the direction transverse to the outward and return directions with the predetermined transport amount changed by changing the second integer, wherein the liquid discharging apparatus is configured to form the at least one adjustment pattern such that a plurality of the adjustment patterns are formed along the outward direction and return direction with each nozzle used in the nozzle row changed after the plurality of reference patterns are formed along the outward direction and return direction, and the liquid discharging apparatus is configured to form the transport amount adjustment pattern using the same nozzle as the nozzle with which a corresponding reference pattern is formed so as to be shifted when viewed from the direction transverse to the outward and return directions direction in the adjustment pattern plurally formed in the direction transverse to the outward and return directions.

9. A liquid discharging apparatus, comprising:

a discharging unit that includes a nozzle row comprising a plurality of nozzles configured to discharge a liquid, the discharging unit being configured to reciprocate in an outward direction and a return direction opposing the outward direction, the outward and return directions being transverse to the nozzle row; and a transport unit configured to intermittently transport a medium in a direction transverse to the outward and return directions, wherein the liquid discharging apparatus is configured to form at least one adjustment pattern for adjusting a transport amount of each individual transport during the intermittent transport, wherein the liquid discharging apparatus is configured to form the at least one adjustment pattern such that the at least one adjustment pattern includes:

at least one first reference pattern formed while moving the discharging unit in the outward direction, at least one second reference pattern formed while moving the discharging unit in the return direction, at least one first transport amount adjustment pattern formed after the medium is transported a predetermined amount after the at least one first reference pattern is formed, at least one second transport amount adjustment pattern formed after the medium is transported a predetermined amount after the at least one second reference pattern is formed, and wherein each predetermined transport amount is at least one of a sum and a difference of (i) a corresponding reference transport amount and (ii) a length in which a second integer equal to or less than a first integer is multiplied by a length in which the distance between neighboring nozzles of the nozzle row is divided by the first integer.

10. The liquid discharging apparatus according to claim 9, wherein the liquid discharging apparatus is configured to form the at least one adjustment pattern such that the at least one adjustment pattern includes a plurality of adjustment patterns formed in the direction transverse to the outward and return directions with the predetermined transport amount changed by changing the second integer, wherein the liquid discharging apparatus is configured to form the at least one adjustment pattern such that a plurality of the adjustment patterns are formed along the outward direction and return direction with each nozzle used in the nozzle row changed after the plurality of reference patterns are formed along the outward direction and return direction, and the liquid discharging apparatus is configured to form the transport amount adjustment pattern using the same nozzle as the nozzle with which a corresponding reference pattern is formed so as to be shifted when viewed from the direction transverse to the outward and return directions direction in the adjustment pattern plurally formed in the direction transverse to the outward and return directions.

* * * * *